US011838711B2

(12) United States Patent
Yang et al.

(10) Patent No.: US 11,838,711 B2
(45) Date of Patent: Dec. 5, 2023

(54) BLUETOOTH EARPHONE

(71) Applicant: Huawei Technologies Co., Ltd., Shenzhen (CN)

(72) Inventors: Chungwen Yang, Dongguan (CN); Zhaocai Zeng, Shanghai (CN); Hanyang Wang, Reading (GB); Haowen Xu, Shanghai (CN); Lin Lu, Shanghai (CN); Huiliang Xu, Dongguan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 128 days.

(21) Appl. No.: 17/605,384

(22) PCT Filed: Jun. 29, 2020

(86) PCT No.: PCT/CN2020/098718
§ 371 (c)(1),
(2) Date: Oct. 21, 2021

(87) PCT Pub. No.: WO2021/000815
PCT Pub. Date: Jan. 7, 2021

(65) Prior Publication Data

US 2022/0159363 A1 May 19, 2022

(30) Foreign Application Priority Data

Jun. 29, 2019 (CN) ..... 201910581500.1

(51) Int. Cl.
*H04R 1/10* (2006.01)
*H01Q 1/22* (2006.01)

(52) U.S. Cl.
CPC ..... *H04R 1/1016* (2013.01); *H01Q 1/2291* (2013.01); *H04R 2420/07* (2013.01)

(58) Field of Classification Search
None
See application file for complete search history.

(56) References Cited

U.S. PATENT DOCUMENTS 10,244,303 B2 3/2019 Xu et al.
10,313,775 B2 * 6/2019 Hankey ..... H04R 1/1041
(Continued)

FOREIGN PATENT DOCUMENTS

CN 2904524 Y 5/2007
CN 206379458 U 8/2017
(Continued)

*Primary Examiner* — Paul W Huber
(74) *Attorney, Agent, or Firm* — Slater Matsil, LLP

(57) ABSTRACT

A Bluetooth earphone includes an earbud portion and an earphone handle portion. A receiver module is disposed in the earbud portion. The earphone handle portion includes a connecting section connected to the earbud portion, and a top section and a bottom section located on both sides of the connecting section, a battery is disposed in the bottom section of the earphone handle portion. The Bluetooth earphone includes an antenna and a flexible circuit board. The antenna extends from the connecting section of the earphone handle portion to the top section of the earphone handle portion. The flexible circuit board includes a feeding part and a first extension part connected to the feeding part. The feeding part is located in the connecting section of the earphone handle portion, and is coupled to the antenna. The first extension part extends to the earbud portion.

19 Claims, 18 Drawing Sheets

(56) References Cited

U.S. PATENT DOCUMENTS

| | | | |
|---|---|---|---|
| 2008/0166004 | A1 | 7/2008 | Sanford et al. |
| 2017/0180844 | A1 | 6/2017 | Nanni et al. |
| 2018/0103312 | A1 | 4/2018 | McAuliffe et al. |

FOREIGN PATENT DOCUMENTS

| | | | |
|---|---|---|---|
| CN | 206658277 | U | 11/2017 |
| CN | 107801117 | A | 3/2018 |
| CN | 108063993 | A | 5/2018 |
| CN | 108281759 | A | 7/2018 |
| CN | 208240880 | U | 12/2018 |
| CN | 109547885 | A | 3/2019 |
| CN | 208675488 | U | 3/2019 |
| CN | 208754499 | U | 4/2019 |
| CN | 110323542 | A | 10/2019 |
| JP | H0496427 | A | 3/1992 |
| JP | 2002271468 | A | 9/2002 |
| JP | 2012054974 | A | 3/2012 |
| JP | 2013219476 | A | 10/2013 |
| JP | 3209546 | U | 3/2017 |

* cited by examiner

BLUETOOTH EARPHONE

CROSS-REFERENCE TO RELATED APPLICATIONS

This application is a National Stage of International Patent Application No. PCT/CN2020/098718, filed on Jun. 29, 2020, which claims priority to Chinese Patent Application No. 201910581500.1, filed on Jun. 29, 2019. All of the aforementioned applications are hereby incorporated by reference in their entireties.

TECHNICAL FIELD

Embodiments of the present disclosure relate to the field of Bluetooth device technologies, and in particular, to a Bluetooth earphone.

BACKGROUND

Currently, a Bluetooth earphone is very popular with users for convenience and miniaturization, and is increasingly widely used. However, since the Bluetooth earphone is directly worn on the head of the user, when an antenna of the Bluetooth earphone works, radiation generated by the earphone antenna is easily absorbed by the head of the user, resulting in reduced antenna efficiency and poor antenna performance.

SUMMARY

Embodiments of the present disclosure provide a Bluetooth earphone with relatively good antenna performance.

The Bluetooth earphone includes an earbud portion and a earphone handle portion. A receiver module is disposed in the earbud portion. The earphone handle portion includes a connecting section connected to the earbud portion, and a top section and a bottom section located on both sides of the connecting section. A battery is disposed in the bottom section of the earphone handle portion. The Bluetooth earphone includes an antenna and a flexible circuit board. The antenna extends from the connecting section of the earphone handle portion to the top section of the earphone handle portion. The flexible circuit board includes a feeding part and a first extension part connected to the feeding part. The feeding part is located in the connecting section of the earphone handle portion, and is coupled to the antenna. The first extension part extends to the earbud portion.

In the embodiments, the antenna extends from the connecting section of the earphone handle portion to the top section of the earphone handle portion, the feeding part of the flexible circuit board is located in the connecting section of the earphone handle portion, and the first extension part extends to the earbud portion. Therefore, a direction of a combined current of a current formed on the antenna and a current formed on the flexible circuit board is from the earbud portion to the top section of the earphone handle portion or from the top section of the earphone handle portion to the earbud portion, so that when a user wears the Bluetooth earphone, a zero radiation point of a radiation field type of an antenna architecture of the Bluetooth earphone faces the head of the user, to greatly reduce an adverse effect of the head of the user on the antenna. In this way, the antenna has relatively good antenna performance.

In an optional embodiment, the antenna includes a feeding end and a tail end far away from the feeding end. The feeding end is coupled to the feeding part. The antenna is configured to form a first current that extends from the feeding end to the tail end. The feeding part includes a feeding position coupled to the antenna. The first extension part includes a first end portion far away from the feeding part. The flexible circuit board is configured to form a second current that extends from the first end portion to the feeding position. The first current and the second current can be combined into an equivalent current in a resonant mode.

The antenna is a ¼ wavelength antenna, to achieve relatively high antenna efficiency. An electrical length of the first current is a ¼, an electrical length of the second current is a ¼, an electrical length of the equivalent current obtained by combining the first current and the second current is a ½ wavelength, and the equivalent current is in the resonant mode, so that an antenna signal is effectively radiated.

In the embodiments, a direction of the first current is from the connecting section of the earphone handle portion to the top section of the earphone handle portion, and a direction of the second current is from the earbud portion to the connecting section of the earphone handle portion. Therefore, a direction of the effective equivalent current is from the earbud portion to the top section of the earphone handle portion, so that after the Bluetooth earphone is worn on an ear of the user, the zero radiation point of the radiation field type generated by the equivalent current faces the head of the user, to greatly reduce the adverse effect of the head of the user on the antenna. In this way, the antenna has relatively good antenna performance.

In an optional embodiment, a straight-line distance between the feeding end and the tail end is less than or equal to a straight-line distance between the feeding position and the first end portion. In this case, sizes of the antenna and the flexible circuit board are limited, to further limit the direction of the equivalent current, so that the zero radiation point of the radiation field type of the antenna architecture can more accurately face the head of the user, to achieve better antenna performance. In an example, a ratio of the straight-line distance between the feeding end and the tail end to the straight-line distance between the feeding position and the first end portion may be greater than or equal to 1:2.

In an optional embodiment, the receiver module is electrically connected to the first extension part, and a connection position at which the first extension part is connected to the receiver module is spaced from the first end portion. The "connection position" is a position, in the first extension part, used to be electrically connected to the receiver module.

In the embodiments, the connection position is located between the first end portion and the feeding part, and the first end portion extends to a side that is of the receiver module and that is far away from the earphone handle portion, and is spaced from the receiver module. That is, a length of the first extension part may be increased by extending the first end portion in a direction far away from the feeding part, to meet an electrical length requirement of the second current.

Optionally, the electronic device further includes a chip. The chip is fastened to the first extension part. The chip includes a radio frequency circuit. The radio frequency circuit is configured to process a radio frequency signal. The radio frequency circuit is coupled to the antenna through the first extension part and the feeding part. The feeding part and the antenna may be coupled by using a conductive member or a capacitor.

In an optional embodiment, the first extension part includes a plurality of regions that are sequentially connected. The plurality of regions include one or more flat regions and one or more curved regions.

In the embodiments, for the first extension part, a straightened part is represented as the flat region, and a bent part is represented as the curved region. A length of the first extension part may be effectively adjusted by bending or straightening the first extension part, that is, by increasing or decreasing a quantity or an area of flat regions and curved regions, so that the second current meets an electrical length requirement.

In an optional embodiment, the first extension part includes a first flat region, a first curved region, and a second flat region that are sequentially connected. The second flat region is bent with respect to the first flat region, and there is an angle less than or equal to 90° between the second flat region and the first flat region.

In the embodiments, the first extension part forms a bent structure in the first flat region, the first curved region, and the second flat region, and there is an angle less than or equal to 90° between the second flat region and the first flat region. Therefore, the bent structure of the first extension part is bent to a relatively large degree, and this helps to increase the length of the first extension part, so as to meet the electrical length requirement of the second current.

In an optional embodiment, the flexible circuit board further includes a second extension part connected to the feeding part. The second extension part extends from the connecting section of the earphone handle portion to the bottom section of the earphone handle portion. The second extension part includes a second end portion far away from the feeding part. The flexible circuit board is further configured to form a third current that extends from the feeding position to the second end portion. An electrical length of the third current is not equal to the electrical length of the second current.

In the embodiments, the electrical length of the second current is a ¼, and the electrical length of the third current is not equal to the electrical length of the second current, and therefore the electrical length of the third current is not equal to a ¼. An electrical length of an equivalent current obtained by combining the third current and the first current is not equal to a ½ wavelength, and the equivalent current is not in the resonant mode. Therefore, the third current does not radiate, and the Bluetooth earphone can effectively suppress radiation of the third current, to ensure directivity and quality of an effective radiation current. In this way, relatively good antenna performance is achieved.

In an optional embodiment, a connection terminal of the battery is disposed opposite to the connecting section of the earphone handle portion, and is connected to the second end portion.

In the embodiments, the connection terminal of the battery is disposed towards a bottom end of the earphone handle portion, and a connection structure between the connection terminal of the battery and the flexible circuit board is located near the bottom end of the earphone handle portion. Therefore, this is conducive to a subsequent repair operation on the battery.

In an optional embodiment, the Bluetooth earphone further includes a microphone module. The microphone module is located in the bottom section of the earphone handle portion, and is located on a side that is of the battery and that is far away from the connecting section of the earphone handle portion. The microphone module is connected to the second end portion. In this case, the microphone module is closer to the bottom end of the earphone handle portion than the battery. When the user wears the Bluetooth earphone, a sound signal sent by the user can be received by the microphone module with better quality and at a faster speed, to ensure sound reception quality and efficiency of the Bluetooth earphone. Similarly, this is more conducive to a subsequent repair operation on the microphone module.

In an optional embodiment, the flexible circuit board further includes a low-pass high-resistance element. The low-pass high-resistance element is connected in series between the feeding part and the second end portion. That is, the low-pass high-resistance element is connected in series to the second extension part, and is located between the feeding part and the second end portion. The low-pass high-resistance element is configured to: allow a current at a frequency band lower than a Bluetooth signal frequency band to pass through, and prevent a current at a frequency band close to the Bluetooth signal frequency band from passing through.

In this implementation, a Bluetooth signal works near 2.4 gigahertz, and a parameter of the low-pass high-resistance element is designed, to allow the current at the frequency band lower than the Bluetooth signal frequency band to pass through and intercept the current at the frequency band close to the Bluetooth signal frequency band, so as to change a longitudinal electrical length of the third current. In this case, the second end portion may extend to an end that is of the bottom section of the earphone handle portion and that is far away from the connecting section of the earphone handle portion, so as to be located at the bottom end of the earphone handle portion. The connection terminal of the battery and the microphone module are connected to the second end portion. A frequency band of each of a current of the battery and a current of the microphone module is far lower than the Bluetooth signal frequency band, and therefore the current of the battery and the current of the microphone module may be transmitted between the second end portion and the chip of the electronic device through the low-pass high-resistance element.

Optionally, the low-pass high-resistance element may be an inductor or a ferrite bead. For example, when the low-pass high-resistance element is an inductor, impedance of the inductor may be greater than 1 nanohenry (nH), for example, may range from 20 nanohenries to 70 nanohenries.

In an optional embodiment, the second extension part includes a plurality of regions that are sequentially connected. The plurality of regions include one or more flat regions and one or more curved regions.

In the embodiments, for the second extension part, a straightened part is represented as the flat region, and a bent part is represented as the curved region. A length of the second extension part may be effectively adjusted by bending or straightening the second extension part, that is, by increasing or decreasing a quantity or an area of flat regions and curved regions, so that the third current meets an electrical length requirement.

In an optional embodiment, the second extension part includes a third flat region, a second curved region, and a fourth flat region that are sequentially connected. The third flat region is bent with respect to the fourth flat region, and there is an angle less than or equal to 90° between the third flat region and the fourth flat region.

In the embodiments, the second extension part forms a bent structure in the third flat region, the second curved region, and the fourth flat region, and there is an angle less than or equal to 90° between the third flat region and the fourth flat region. Therefore, the bent structure of the second extension part is bent to a relatively large degree, and this helps to increase the length of the second extension part, so as to meet the electrical length requirement of the third current.

In an optional embodiment, the antenna is a monopole antenna or an inverted-F antenna. The electronic device further includes an antenna support. In an example, the antenna is formed on the antenna support. In another example, the antenna is assembled to the antenna support to form an integrated structure.

In an optional embodiment, the antenna is a ceramic antenna, a circuit board antenna, a stamping antenna, a laser direct structuring antenna, or an insert molding antenna. For example, the antenna is a laser direct structuring antenna, and the antenna is formed on the antenna support by alternately performing a coating process and a baking process for a plurality of times. The antenna support may be made of ceramic or plastic.

DETAILED DESCRIPTION OF ILLUSTRATIVE EMBODIMENTS

The following describes the embodiments of the present disclosure with reference to the accompanying drawings in the embodiments of the present disclosure.

Figure 1:
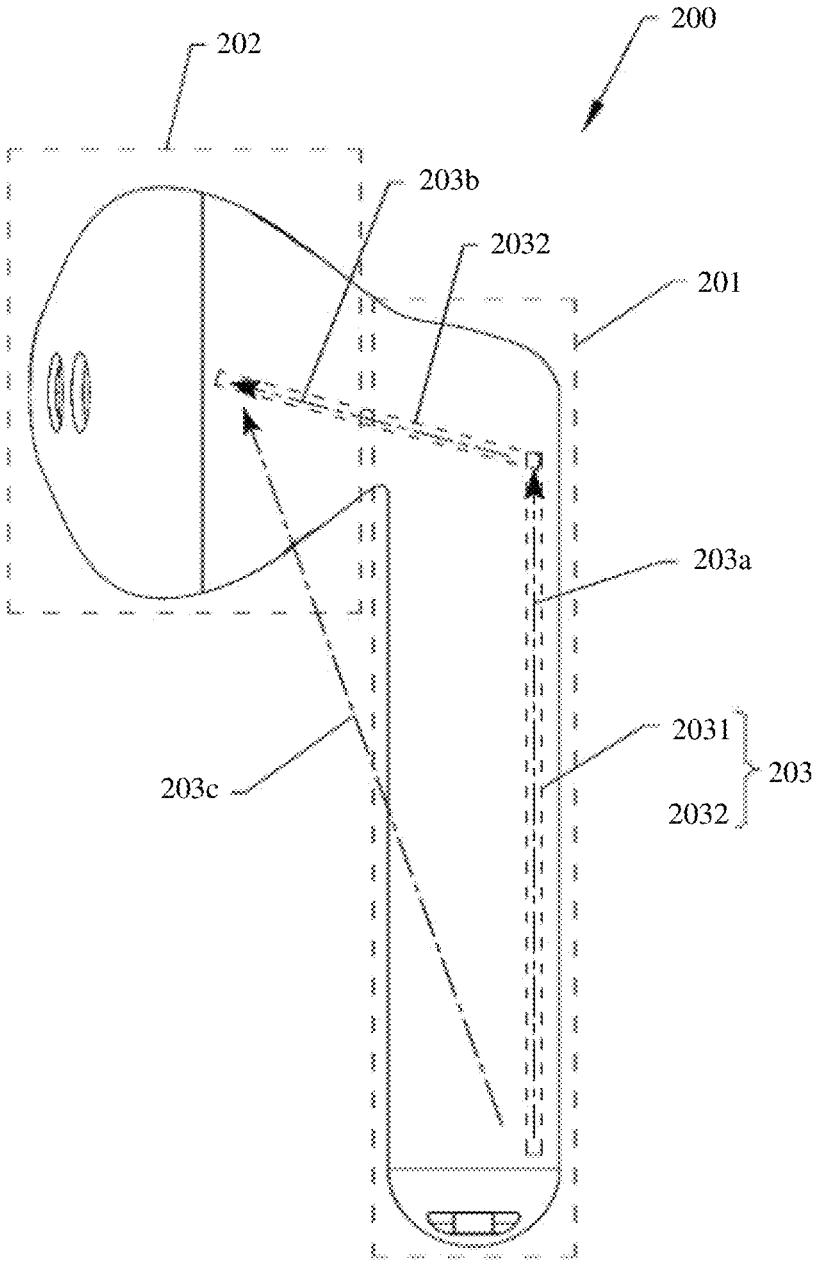
FIG. 1 is a schematic diagram of a conventional Bluetooth earphone.

FIG. 1 is a schematic diagram of a conventional Bluetooth earphone 200. The Bluetooth earphone 200 includes a earphone handle portion 201 and an earbud portion 202. The earbud portion 202 is connected to a top end of the earphone handle portion 201. An antenna architecture 203 of the Bluetooth earphone 200 includes a strip antenna 2031 and a transmission cable (cable) 2032 connected to one end of the strip antenna 2031. The strip antenna 2031 is located in the earphone handle portion 201, and extends longitudinally. The transmission cable 2032 is configured to transmit a radio frequency signal. The transmission cable 2032 extends from the top end of the earphone handle portion 201 to the earbud portion 202. In the antenna architecture 203, the strip antenna 2031 is configured to form an antenna current 203*a*, and the transmission cable 2032 is configured to form a ground current 203*b*. The antenna current 203*a* and the ground current 203*b* are combined into an equivalent current 203*c* shown in the figure. As shown in FIG. 1, a direction of the equivalent current 203*c* is approximately a direction from a bottom end of the earphone handle portion 201 to the earbud portion 202.

Figure 2:
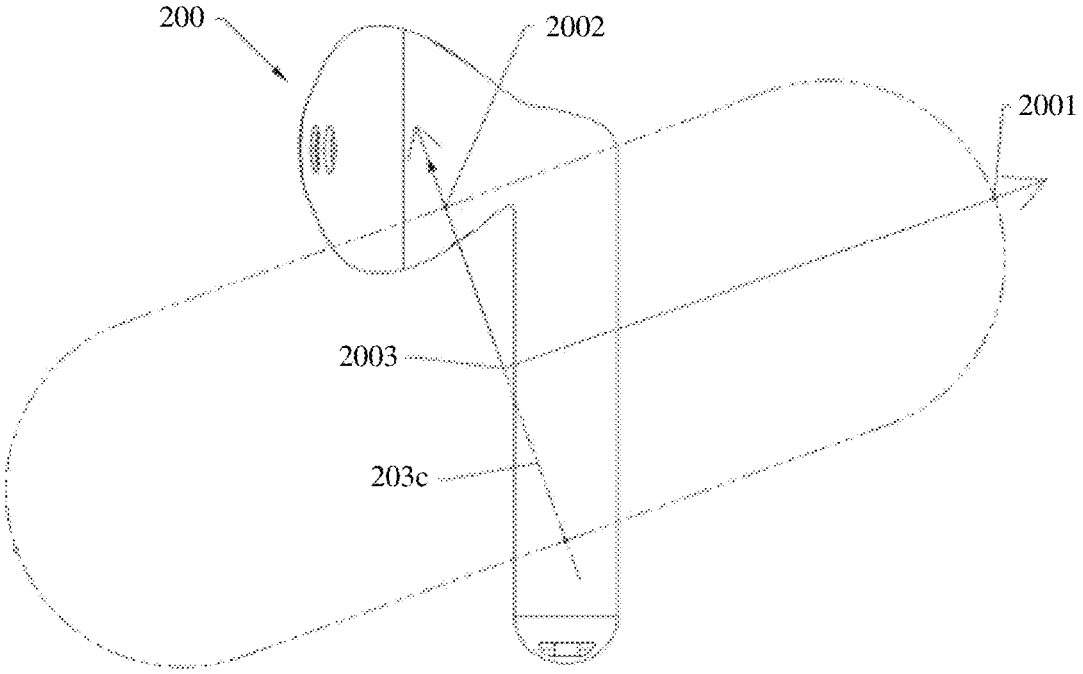
FIG. 2 is a schematic diagram of a radiation field type of an antenna architecture of the Bluetooth earphone shown in FIG. 1.

FIG. 2 is a schematic diagram of a radiation field type of the antenna architecture 203 of the Bluetooth earphone 200 shown in FIG. 1. As shown in FIG. 2, the equivalent current 203*c* is in a resonant mode, and has an electrical length of a ½ wavelength. A radiation field type generated by the equivalent current 203*c* includes a strong radiation point 2001 with relatively strong radiation and a zero radiation point 2002 with relatively weak radiation. A line that connects a center 2003 of the radiation field type and the zero radiation point 2002 is parallel to the direction of the equivalent current 203*c*, and a line that connects the center 2003 of the radiation field type and the strong radiation point 2001 is perpendicular to the direction of the equivalent current 203*c*.

Figure 3:
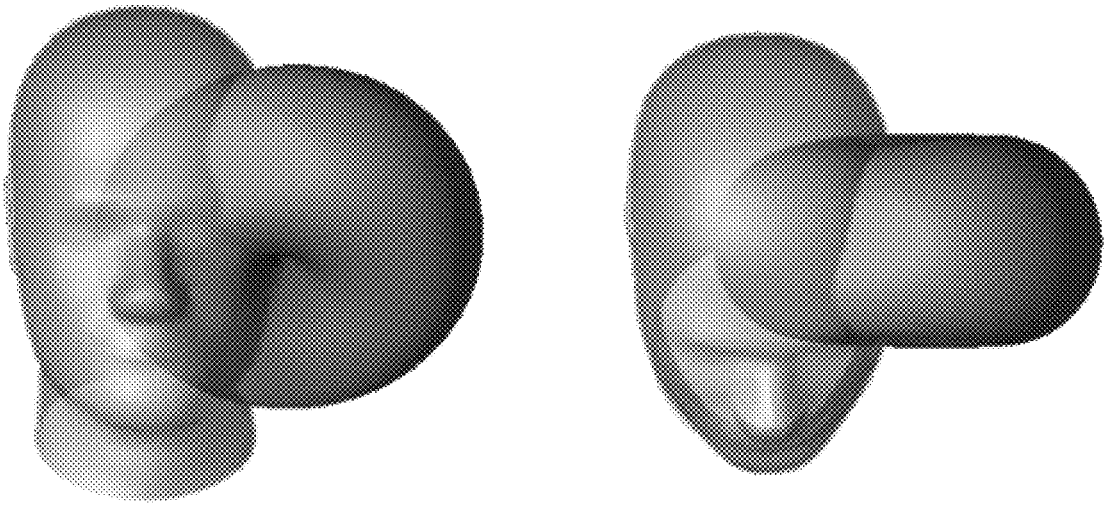
FIG. 3 is a schematic diagram in which a free space radiation field type of an antenna architecture of the Bluetooth earphone shown in FIG. 1 corresponds to a head phantom.

FIG. 3 is a schematic diagram in which a free space radiation field type of the antenna architecture 203 of the Bluetooth earphone 200 shown in FIG. 1 corresponds to a head phantom. FIG. 3 includes schematic diagrams at two angles. It may be learned from FIG. 2 and FIG. 3 that when a user wears the Bluetooth earphone 200, the equivalent current 203*c* of the antenna architecture 203 of the Bluetooth earphone 200 is approximately parallel to the head of the user, and the strong radiation point 2001 of the radiation field type of the antenna architecture 203 of the Bluetooth earphone 200 faces the head of the user.

Figure 4:
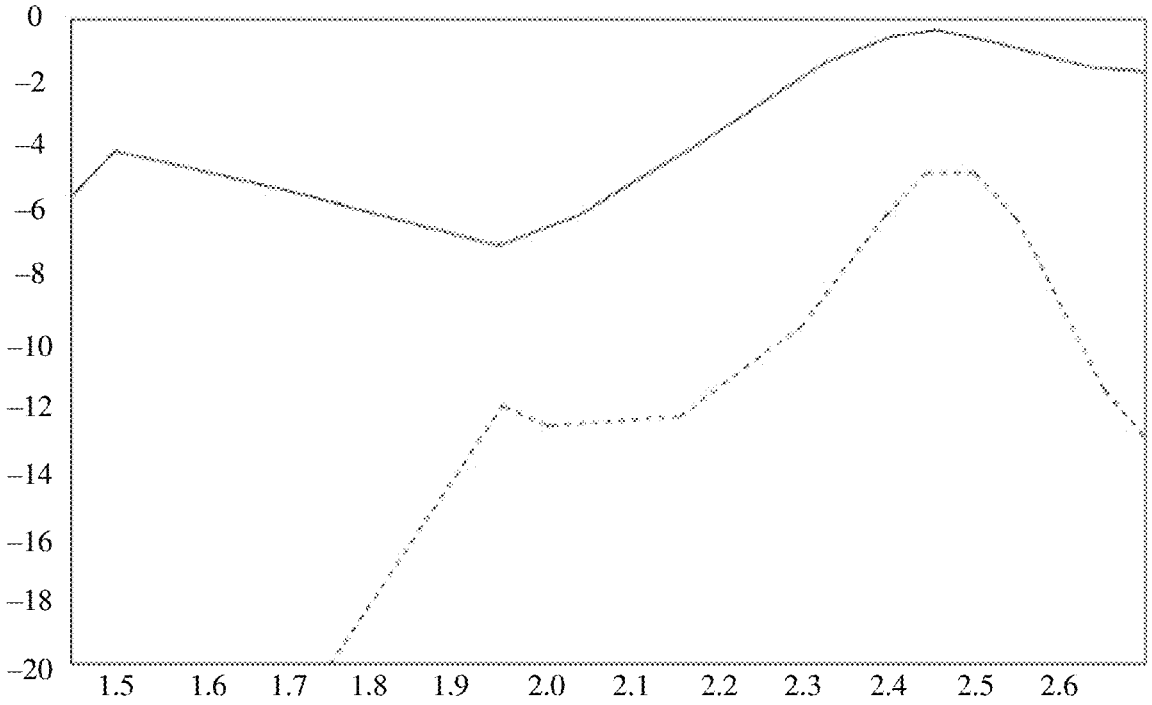
FIG. 4 is a comparison diagram of efficiency achieved when an antenna of the Bluetooth earphone shown in FIG. 1 is used in different environments.

FIG. 4 is a comparison diagram of efficiency achieved when an antenna of the Bluetooth earphone 200 shown in FIG. 1 is used in different environments. A solid-line curve in FIG. 4 represents antenna efficiency achieved when the Bluetooth earphone 200 is not worn, namely, antenna efficiency achieved when the Bluetooth earphone 200 is in an initial state. A dashed-line curve in FIG. 4 represents antenna efficiency achieved when the Bluetooth earphone 200 is worn on the head of the user. In FIG. 4, a horizontal coordinate represents a frequency in a unit of gigahertz (GHz), and a vertical coordinate represents efficiency in a unit of decibel (dB).

In FIG. 4, when the user wears the Bluetooth earphone 200, the antenna efficiency of the Bluetooth earphone 200 is greatly reduced compared with that in the initial state. It may be learned from this that when the strong radiation point 2001 of the radiation field type of the antenna architecture 203 of the Bluetooth earphone 200 faces the head of the user, the head of the user absorbs radiation of the antenna to a large extent, resulting in a significant reduction in the efficiency of the antenna and great impact on performance of the antenna.

Based on this, the embodiments of the present disclosure provide a Bluetooth earphone. When the Bluetooth earphone is worn on the head of a user, a strong radiation point of a radiation field type generated by an equivalent current of an antenna architecture of the Bluetooth earphone does not face the head of the user, but a zero radiation point of the radiation field type faces the head of the user, to improve an undesirable situation in which the head of the user absorbs antenna radiation and reduce an adverse effect of the head of the user on antenna performance, so that an antenna of the Bluetooth earphone has relatively high efficiency and relatively good performance.

Figure 5:
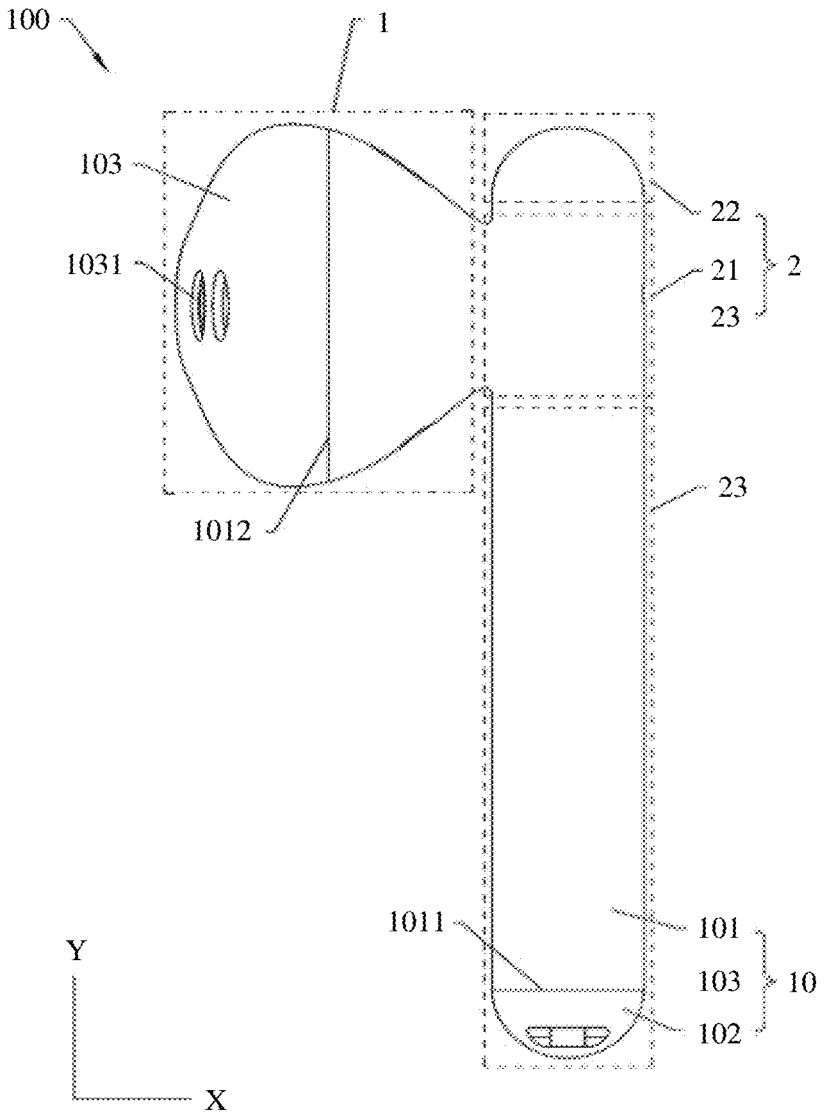
FIG. 5 is a schematic structural diagram of a Bluetooth earphone according to an embodiment of the present disclosure.

FIG. 5 is a schematic structural diagram of a Bluetooth earphone 100 according to an embodiment of the present disclosure. For ease of description, description is provided below by using a Y direction shown in FIG. 5 as a longitudinal direction and an X direction shown in FIG. 5 as a transverse direction.

The Bluetooth earphone 100 includes an earbud portion 1 and a earphone handle portion 2. The earphone handle portion 2 includes a connecting section 21 connected to the earbud portion 1, and a top section 22 and a bottom section 23 located on both sides of the connecting section 21. The top section 22, the connecting section 21, and the bottom section 23 of the earphone handle portion 2 are sequentially longitudinally arranged. The earbud portion 1 is configured to be partially inserted into an ear of a user. The earphone handle portion 2 is configured to come into contact with the ear of the user. When the user wears the Bluetooth earphone 100, the earbud portion 1 is partially inserted into the ear of the user, and the earphone handle portion 2 is located outside the ear of the user, and comes into contact with the ear of the user.

Figure 6:
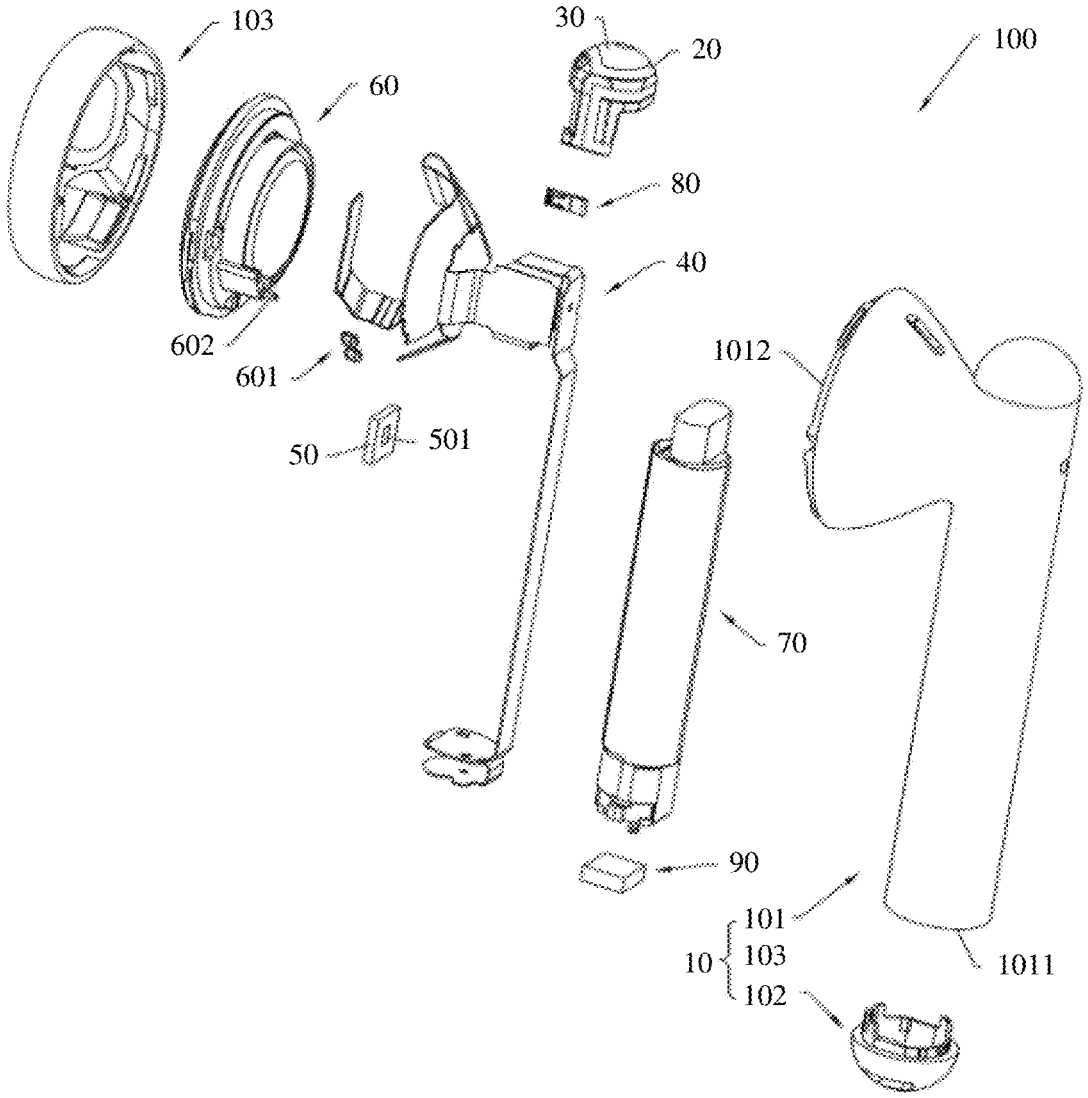
FIG. 6 is a partial schematic exploded diagram of the Bluetooth earphone shown in FIG. 5.

Referring to both FIG. 5 and FIG. 6, FIG. 6 is a partial schematic exploded diagram of the Bluetooth earphone 100 shown in FIG. 5. The Bluetooth earphone 100 includes a housing 10. The housing 10 is configured to accommodate another component of the Bluetooth earphone 100, to fasten and protect the another component. The housing 10 includes a main housing 101, a bottom housing 102, and a side housing 103. The main housing 101 is partially located in the earphone handle portion 2 of the Bluetooth earphone 100, and partially located in the earbud portion 1 of the Bluetooth earphone 100. The main housing 101 forms a first opening 1011 in the bottom section 23 of the earphone handle portion 2 of the Bluetooth earphone 100, and forms a second opening 1012 in the earbud portion 1 of the Bluetooth earphone 100. The another component of the Bluetooth earphone 100 may be incorporated into the main housing 101 from the first opening 1011 or the second opening 1012. The bottom housing 102 is located in the bottom section 23 of the earphone handle portion 2 of the Bluetooth earphone 100, and is permanently connected to the main housing 101. The bottom housing 102 is mounted in the first opening 1011. The side housing 103 is located in the earbud portion 1 of the Bluetooth earphone 100, and is permanently connected to the main housing 101. The side housing 103 is mounted in the second opening 1012.

There is a detachable connection (for example, a snap-on connection or a threaded connection) between the bottom housing 102 and the main housing 101, to facilitate subsequent repair or maintenance of the Bluetooth earphone 100. In another implementation, there may be a non-detachable connection (for example, an adhesive connection) between the bottom housing 102 and the main housing 101, to reduce a risk that the bottom housing 102 accidentally falls off, so that the Bluetooth earphone 100 is more reliable.

There is a detachable connection (for example, a snap-on connection or a threaded connection) between the side housing 103 and the main housing 101, to facilitate subsequent repair or maintenance of the Bluetooth earphone 100. In another embodiment, there may be a non-detachable connection (for example, an adhesive connection) between the side housing 103 and the main housing 101, to reduce a risk that the side housing 103 accidental falls off, so that the Bluetooth earphone boo is more reliable.

One or more sound output holes 1031 are disposed in the side housing 103, so that sound inside the housing 10 can be transmitted to outside of the housing 10 through the sound output holes 1031. A shape, position, and quantity of sound output holes 1031 are not strictly limited in the present disclosure.

Figure 7:
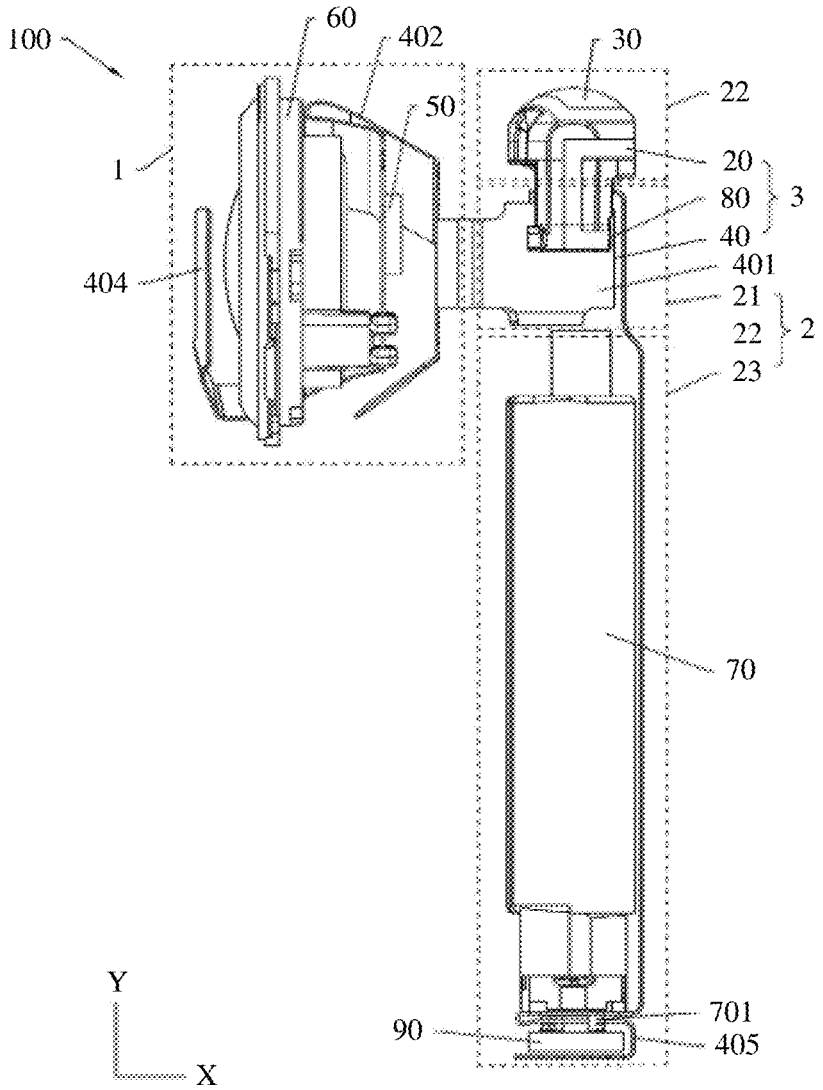
FIG. 7 is a schematic diagram of an internal structure of the Bluetooth earphone shown in FIG. 5.

Referring to both FIG. 6 and FIG. 7, FIG. 7 is a schematic diagram of an internal structure of the Bluetooth earphone 100 shown in FIG. 5.

The Bluetooth earphone 100 further includes an antenna 20, an antenna support 30, a flexible circuit board 40, a chip 50, a receiver module 60, and a battery 70.

The antenna 20 extends from the connecting section 21 of the earphone handle portion 2 to the top section 22 of the earphone handle portion 2. Optionally, the antenna 20 may be a monopole antenna, an inverted-F antenna (IFA), or the like. Optionally, the antenna 20 may be a ceramic antenna, a circuit board antenna, a stamping antenna, a laser direct structuring (laser direct structuring, LDS) antenna, an insert molding antenna, or the like. In this embodiment, description is provided by using an example in which the antenna 20 is a laser direct structuring antenna.

The antenna support 30 extends from the connecting section 21 of the earphone handle portion 2 to the top section 22 of the earphone handle portion 2. The antenna bracket 30 is configured to fasten and support the antenna 20. In this embodiment, the antenna 20 is formed on the antenna support 30. For example, the antenna 20 is formed on the antenna support 30 by alternately performing a coating process and a baking process for a plurality of times. In an example, the antenna 20 is formed by alternately performing the coating process and the baking process for three times, to increase a product yield. In another embodiment, the antenna 20 may be fastened to the antenna support 30 through assembly. For example, the antenna 20 is welded or bonded to the antenna support 30.

Optionally, the antenna support 30 may be made of ceramic. In this case, a size of the antenna 20 can be effectively reduced because the ceramic has a relatively large dielectric constant. In another embodiment, the antenna support 30 may be made of plastic.

The flexible circuit board 40 extends from the earbud portion 1 to the bottom section 23 of the earphone handle portion 2 through the connecting section 21 of the earphone handle portion 2. The flexible circuit board 40 may form one or more bent structures in the earbud portion 1 and the earphone handle portion 2. The flexible circuit board 40 is configured to transmit a signal.

The chip 50 is located in the earbud portion 1. The chip 50 is fastened to the flexible circuit board 40. The chip 50 may be fastened through welding, and is electrically connected to the flexible circuit board 40. Optionally, the chip 50 may be a system on chip (system on chip, SOC). The chip 50 includes a radio frequency circuit 501. The radio frequency circuit 501 is configured to process a radio frequency signal. For example, the radio frequency circuit 501 is configured to modulate/demodulate a radio frequency signal. The radio frequency circuit 501 is coupled to the antenna 20 through the flexible circuit board 40. Optionally, the Bluetooth earphone 100 further includes a conductive member 80. The conductive member 80 may be a spring. The conductive member 80 is located in the connecting section 21 of the earphone handle portion 2. The conductive member 80 is connected to the flexible circuit board 40 and the antenna 20 located on the antenna support 30. An antenna architecture 3 of the Bluetooth earphone 100 includes the flexible circuit board 40, the antenna 20, and the conductive member 80. In another embodiment, the conductive member 80 may be another structure, for example, conductive adhesive. In another embodiment, the conductive member 80 may be replaced with a capacitor, and the flexible circuit board 40 is coupled to the antenna 20 by using the capacitor.

The receiver module 60 is disposed in the earbud portion 1. The receiver module 60 is connected to the flexible circuit board 40. The receiver module 60 is coupled to the chip 50. The receiver module 60 is configured to convert an electrical signal into a sound signal. The receiver module 60 is located on a side that is of the chip 50 and that is far away from the earphone handle portion 2. In this case, the receiver module 60 is closer to outside of the Bluetooth earphone 100, and the sound signal formed by the receiver module 60 is more easily output to the outside of the Bluetooth earphone 100. The Bluetooth earphone 100 may further include a fixed terminal pair 601. The fixed terminal pair 601 is located in the earbud portion 1. The fixed terminal pair 601 is permanently connected to the flexible circuit board 40. A connection terminal 602 of the receiver module 60 is inserted into the fixed terminal pair 601 to be electrically connected to the flexible circuit board 40.

The battery 70 is disposed in the bottom section 23 of the earphone handle portion 2. The battery 70 is connected to the flexible circuit board 40. The battery 70 is coupled to the chip 50. The battery 70 is configured to supply power to the Bluetooth earphone 100. In this embodiment, the battery 70 is in a strip shape to be better accommodated in the main housing 101. In another embodiment, the battery 70 may be in another shape. The Bluetooth earphone 100 may further include a microphone module 90. The microphone module 90 is located in the bottom section 23 or the connecting section 21 of the earphone handle portion 2. The microphone module 90 may be located on a side that is of the battery 70 and that is far away from the antenna 20, or located between the battery 70 and the antenna 20. The microphone module 90 is connected to the flexible circuit board 40. The microphone module 90 is coupled to the chip 50. The microphone module 90 is configured to convert a sound signal into an electrical signal.

Figure 8:
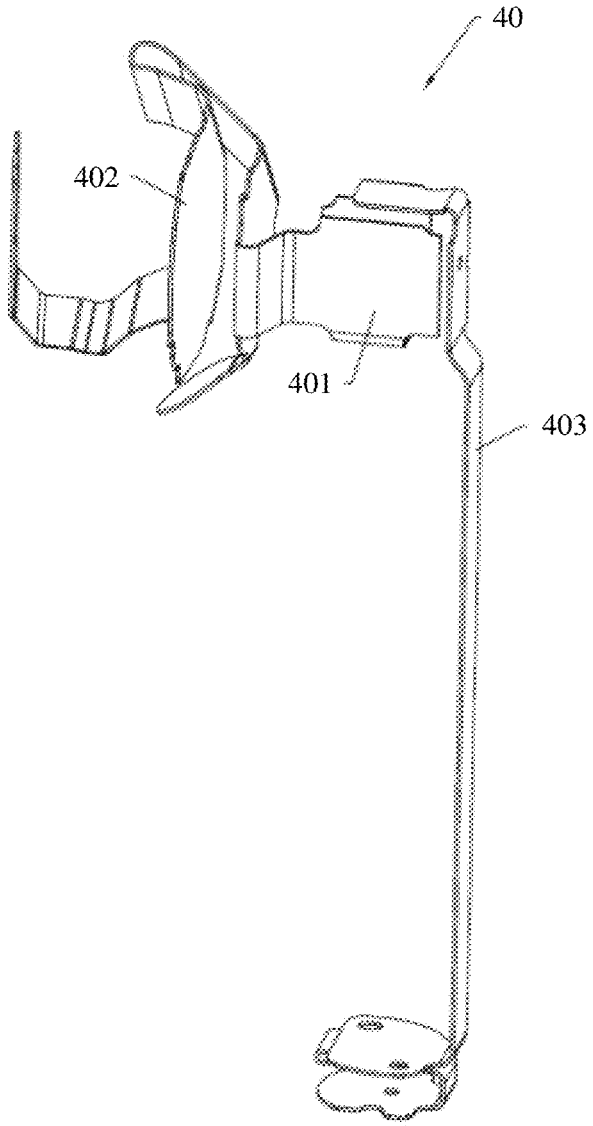
FIG. 8 is a schematic structural diagram of a flexible circuit board shown in FIG. 6.
Figure 9:
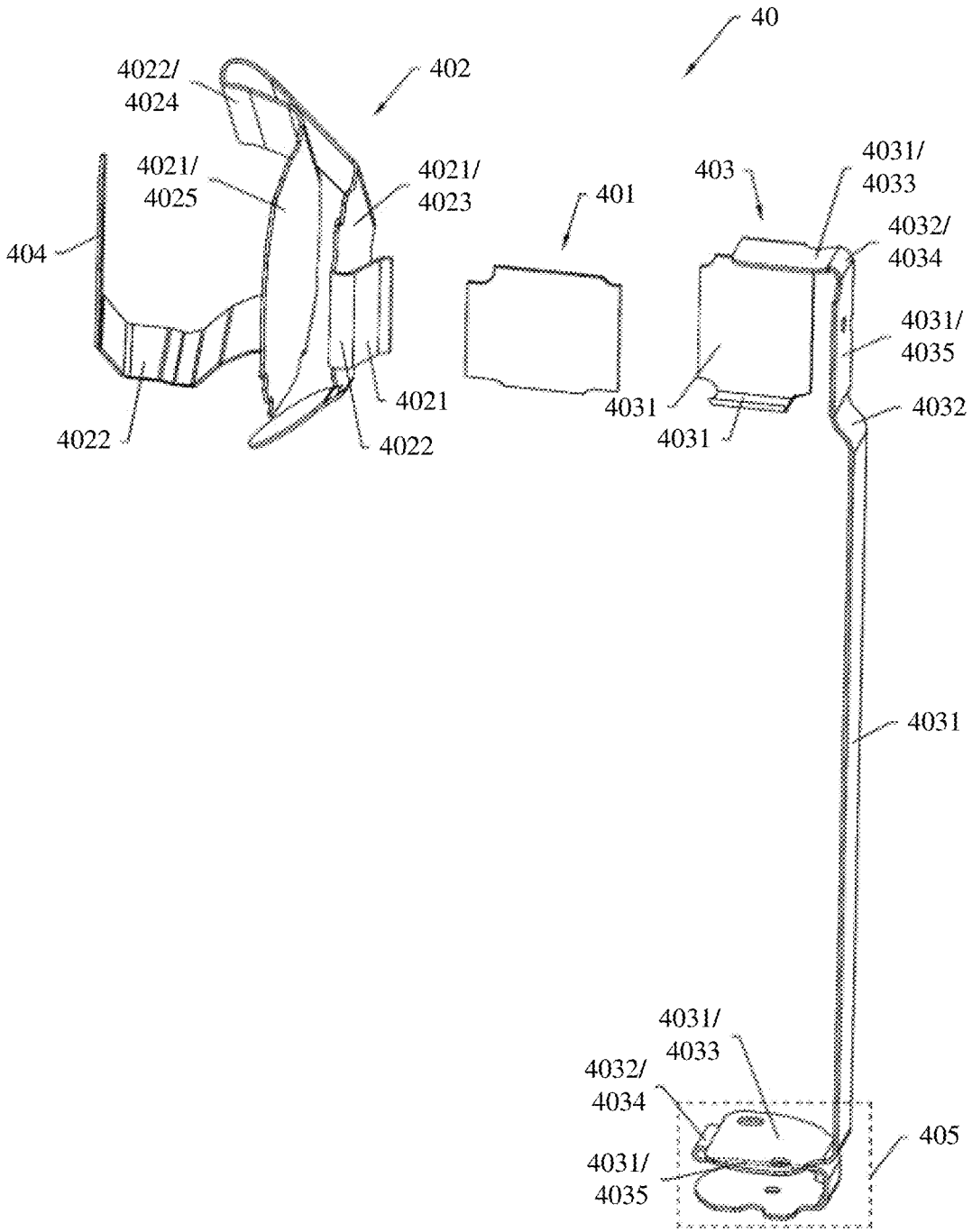
FIG. 9 is a schematic exploded structural diagram of the flexible circuit board shown in FIG. 8.

Referring to both FIG. 8 and FIG. 9, FIG. 8 is a schematic structural diagram of the flexible circuit board 40 shown in FIG. 6, and FIG. 9 is a schematic exploded structural diagram of the flexible circuit board 40 shown in FIG. 8.

The flexible circuit board 40 includes a feeding part 401 and a first extension part 402 connected to the feeding part 401. The first extension part 402 is connected to one side of the feeding part 401. The flexible circuit board 40 further includes a second extension part 403 connected to the feeding part 401. The second extension part 403 is connected to the other side of the feeding part 401. The feeding part 401 is connected to one side of the first extension part 402 and the other side of the second extension part 403. The two sides may be disposed adjacent or opposite to each other.

The first extension part 402 includes a first end portion 404 far away from the feeding part 401. The second extension part 403 includes a second end portion 405 far away from the feeding part 401. The first end portion 404 and the second end portion 405 may be two end portions of the flexible circuit board 40.

Optionally, the feeding part 401, the first extension part 402, and the second extension part 403 are integrally formed. In another embodiment, the feeding part 401, the first extension part 402, and the second extension part 403 may form an integrated structure through assembly.

Optionally, the flexible circuit board 40 may include one or more stiffening plates (not shown in the figure). The one or more stiffening plates are disposed in a stiffening region of the flexible circuit board 40. The stiffening region of the flexible circuit board 40 is mainly a region, in the flexible circuit board 40, that needs to be connected to another component, or is a region used to carry another component.

Figure 10A:
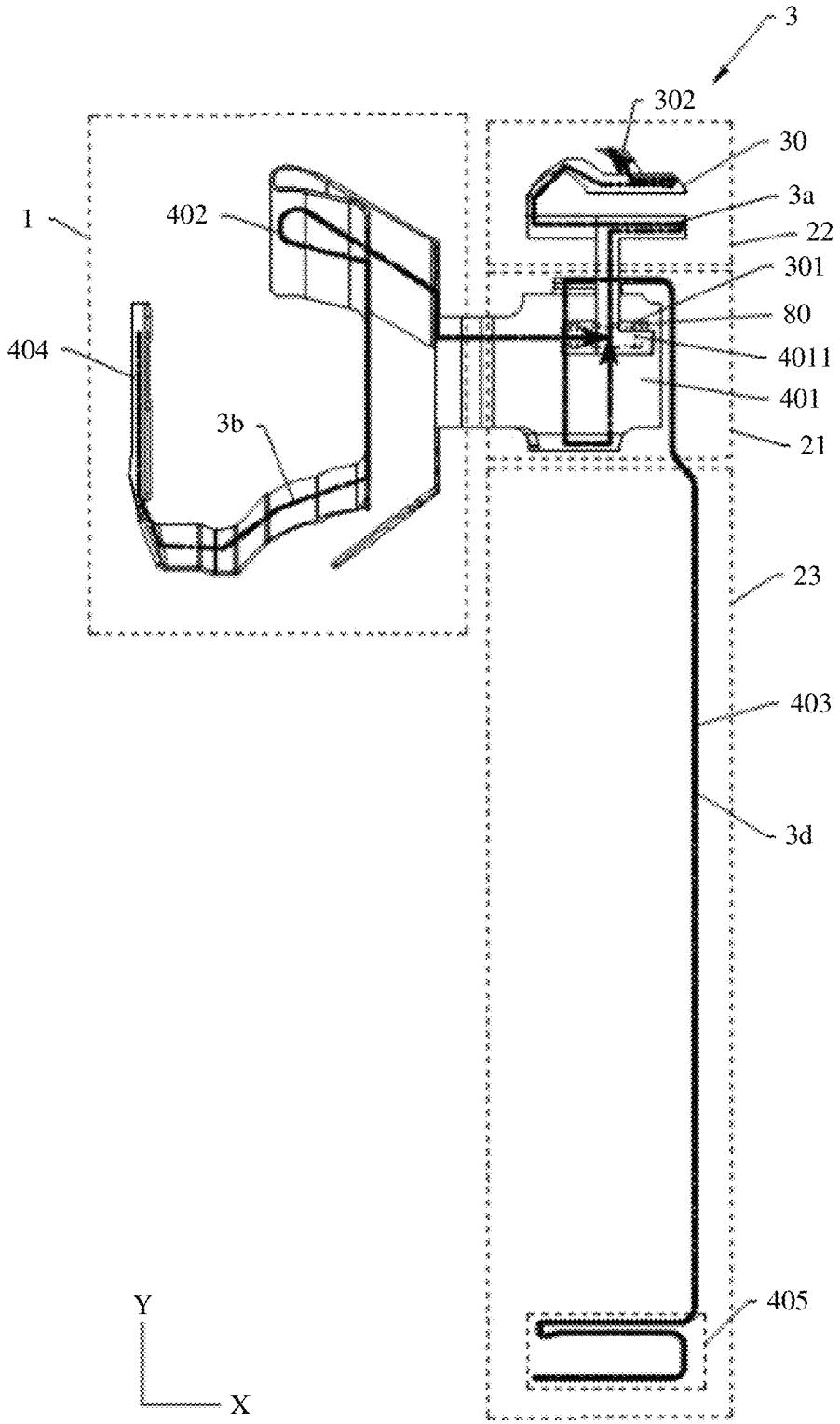
FIG. 10A is a schematic structural diagram of an antenna architecture of the Bluetooth earphone shown in FIG. 7.

Referring to both FIG. 9 and FIG. 10A, FIG. 10A is a schematic structural diagram of the antenna architecture 3 of the Bluetooth earphone 100 shown in FIG. 7.

The feeding part 401 of the flexible circuit board 40 is located in the connecting section 21 of the earphone handle portion 2, and is coupled to the antenna 20. In this embodiment, the feeding part 401 is coupled to the antenna 20 through the conductive member 80. The first extension part 402 extends to the earbud portion 1. A large part or a small part of the first extension part 402 is located in the earbud portion 1, or the first extension part 402 is not located in the earbud portion 1. The second extension part 403 extends from the connecting section 21 of the earphone handle portion 2 to the bottom section 23 of the earphone handle portion 2.

In this embodiment, the antenna 20 extends from the connecting section 21 of the earphone handle portion 2 to the top section 22 of the earphone handle portion 2, the feeding part 401 of the flexible circuit board 40 is located in the connecting section 21 of the earphone handle portion 2, and the first extension part 402 extends to the earbud portion 1. Therefore, a direction of a combined current of a current formed on the antenna 20 and a current formed on the flexible circuit board 40 is from the earbud portion 1 to the top section 22 of the earphone handle portion 2 or from the top section 22 of the earphone handle portion 2 to the earbud portion 1, so that when the user wears the Bluetooth earphone 100, a zero radiation point of a radiation field type of the antenna architecture 3 of the Bluetooth earphone 100 faces the head of the user, to greatly reduce an adverse effect of the head of the user on the antenna 20. In this way, the antenna 20 has relatively good antenna performance.

Figure 10B:
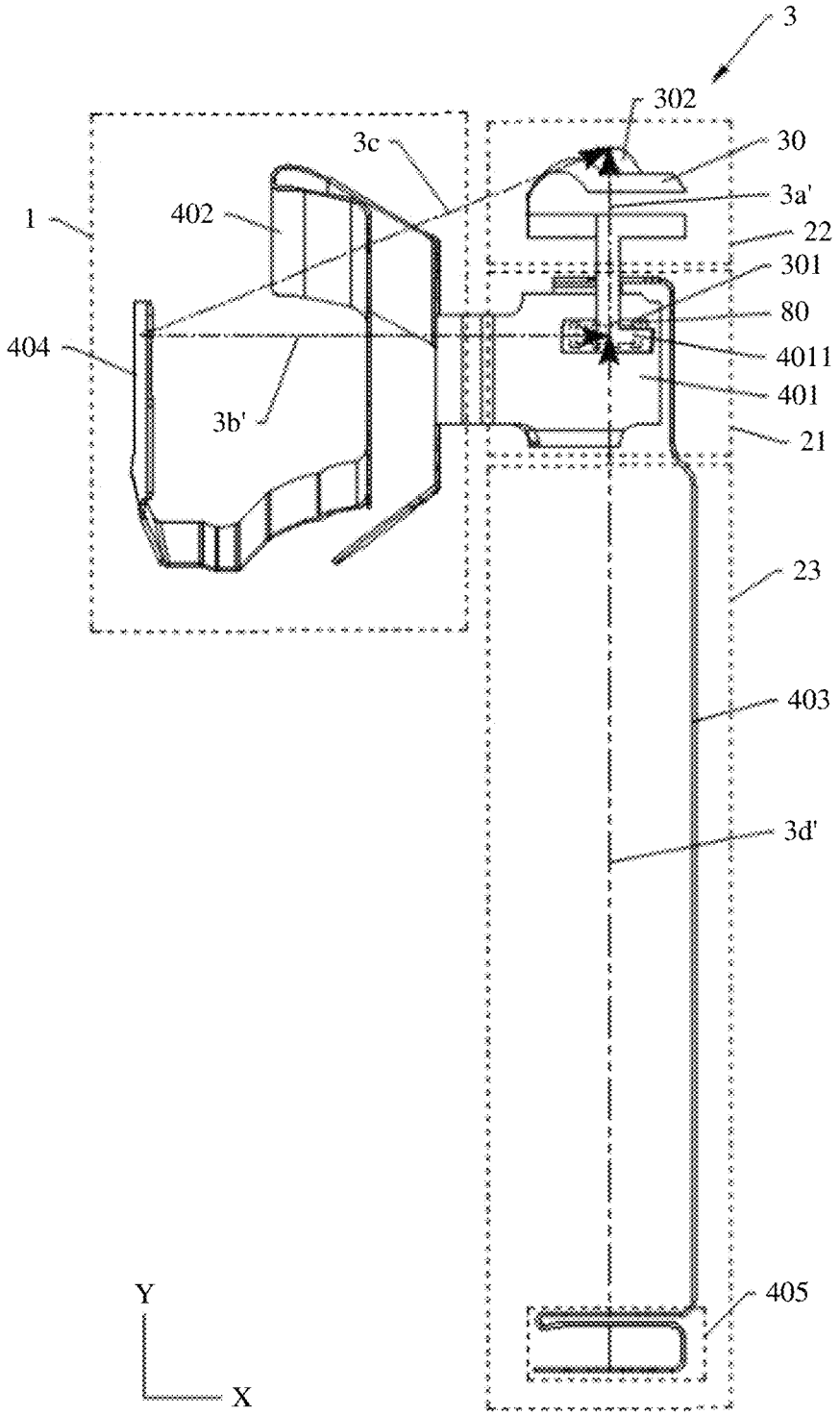
FIG. 10B is another schematic diagram of a structure shown in FIG. 10A.

Referring to both FIG. 10A and FIG. 10B, FIG. 10B is another schematic diagram of the structure shown in FIG. 10A.

Optionally, the antenna 30 includes a feeding end 301 and a tail end 302 far away from the feeding end 301. The feeding end 301 is coupled to the feeding part 401. The antenna 30 is configured to form a first current 3*a* that extends from the feeding end 301 to the tail end 302. The first current 3*a* is an antenna current. The feeding part 401 includes a feeding position 4011 coupled to the antenna 30. The first extension part 402 includes the first end portion 404 far away from the feeding part 401. The flexible circuit board 40 is configured to form a second current 3*b* that extends from the first end portion 404 to the feeding position 4011. The second current 3*b* is a ground current. The first current 3*a* and the second current 3*b* can be combined into an equivalent current in a resonant mode.

As shown in FIG. 10A, a flow direction of the first current 3*a* varies with a shape direction of the antenna 20. For ease of description, the first current 3*a* is equivalent to a longitudinal first equivalent current 3*a*' in FIG. 10B. As shown in FIG. 10A, a flow direction of the second current 3*b* varies with a shape of a part, of the flexible circuit board 40, from the feeding position 4011 to the first end portion 404. For ease of description, the second current 3*b* is equivalent to a longitudinal second equivalent current 3*b*' in FIG. 10B. The equivalent current obtained by combining the first current 3*a* and the second current 3*b* is an equivalent current 3*c* obtained by combining the first equivalent current 3*a*' and the second equivalent current 3*b*'.

The antenna 20 is a ¼ antenna, to achieve relatively high antenna efficiency. An electrical length of the first current 3*a* is a ¼, an electrical length of the second current 3*b* is a ¼, an electrical length of the equivalent current obtained by combining the first current 3*a* and the second current 3*b* is a ½ wavelength, and the equivalent current is in the resonant mode, so that an antenna signal is effectively radiated.

In this embodiment, the direction of the first current 3*a* is from the connecting section 21 of the earphone handle portion 2 to the top section 22 of the earphone handle portion 2, and the direction of the second current 3*b* is a direction from the earbud portion 1 to the connecting section 21 of the earphone handle portion 2. Therefore, a direction of the equivalent current 3*c* obtained by combining the first current 3*a* and the second current 3*b* is from the earbud portion 1 to the top section 22 of the earphone handle portion 2.

It may be understood that the first current 3*a* is an alternating current, and therefore in another status, the direction of the first current 3*a* is from the top section 22 of the earphone handle portion 2 to the connecting section 21 of the earphone handle portion 2, the direction of the second current 3*b* is from the connecting section 21 of the earphone handle portion 2 to the earbud portion 1, and the direction of the equivalent current 3*c* is from the top section 22 of the earphone handle portion 2 to the earbud portion 1.

It may be understood that in the embodiment of the present disclosure, a medium that carries the first current 3*a* or the second current 3*b* whose electrical length is a ¼ wavelength is affected by a medium surrounding a path of the first current 3*a* or the second current 3*b*, and therefore an actual physical length of the first current 3*a* or the second current 3*b* is less than the ¼ wavelength.

Figure 11:
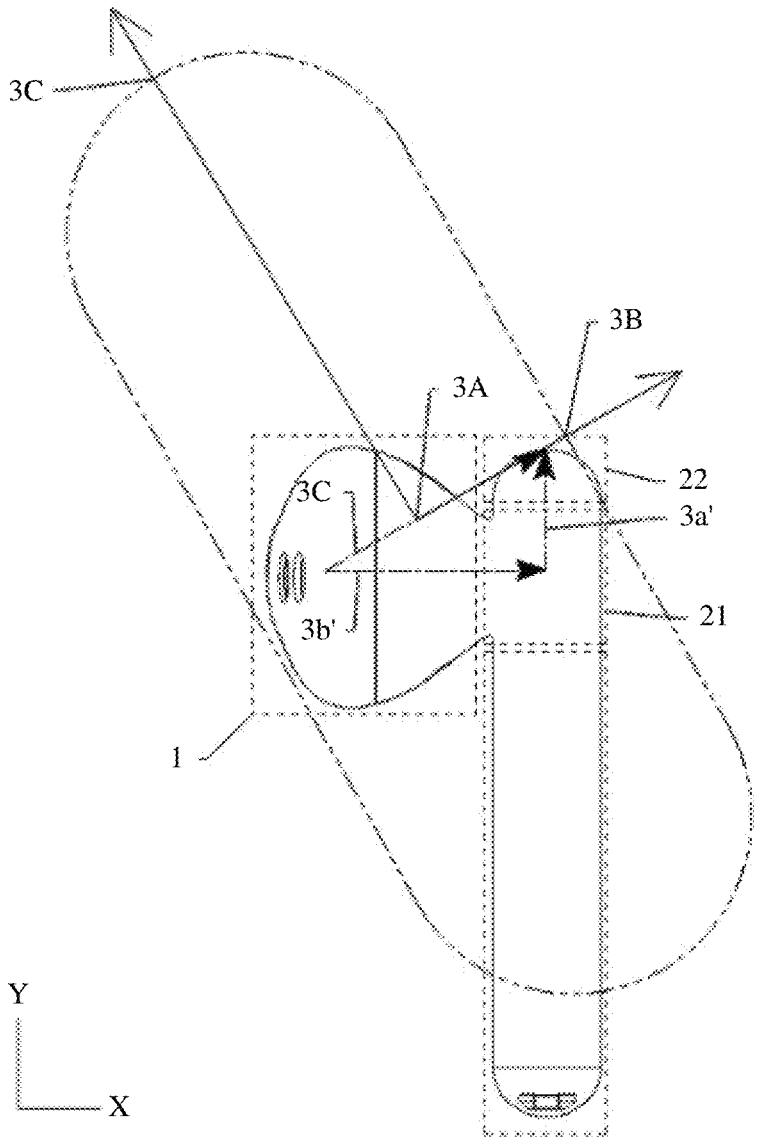
FIG. 11 is a schematic diagram of a radiation field type of an antenna architecture of the Bluetooth earphone shown in FIG. 7.
Figure 12:
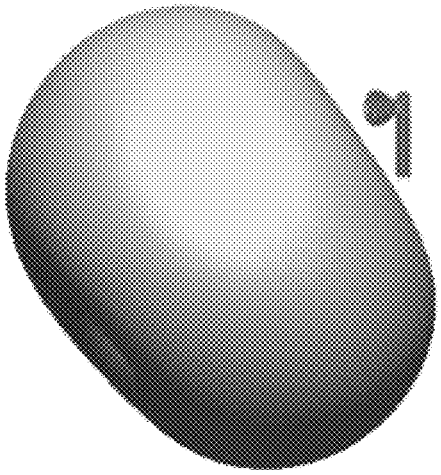
FIG. 12 is a simulation diagram of a radiation field type of an antenna architecture of the Bluetooth earphone shown in FIG. 7.

Referring to both FIG. 11 and FIG. 12, FIG. 11 is a schematic diagram of a radiation field type of the antenna architecture 3 of the Bluetooth earphone 100 shown in FIG. 7, and FIG. 12 is a simulation diagram of a radiation field type of the antenna architecture 3 of the Bluetooth earphone 100 shown in FIG. 7.

As shown in FIG. 11 and FIG. 12, the direction of the equivalent current 3*c* of the antenna architecture 3 of the Bluetooth earphone 100 is from the earbud portion 1 to the top section 22 of the earphone handle portion 2 of the Bluetooth earphone 100, a line that connects a center 3A of the radiation field type and a zero radiation point 3B is parallel to the direction from the earbud portion 1 to the top section 22 of the earphone handle portion 2, and a line that connects the center 3A of the radiation field type and a strong radiation point 3C is perpendicular to the direction from the earbud portion 1 to the top section 22 of the earphone handle portion 2.

Figure 13:
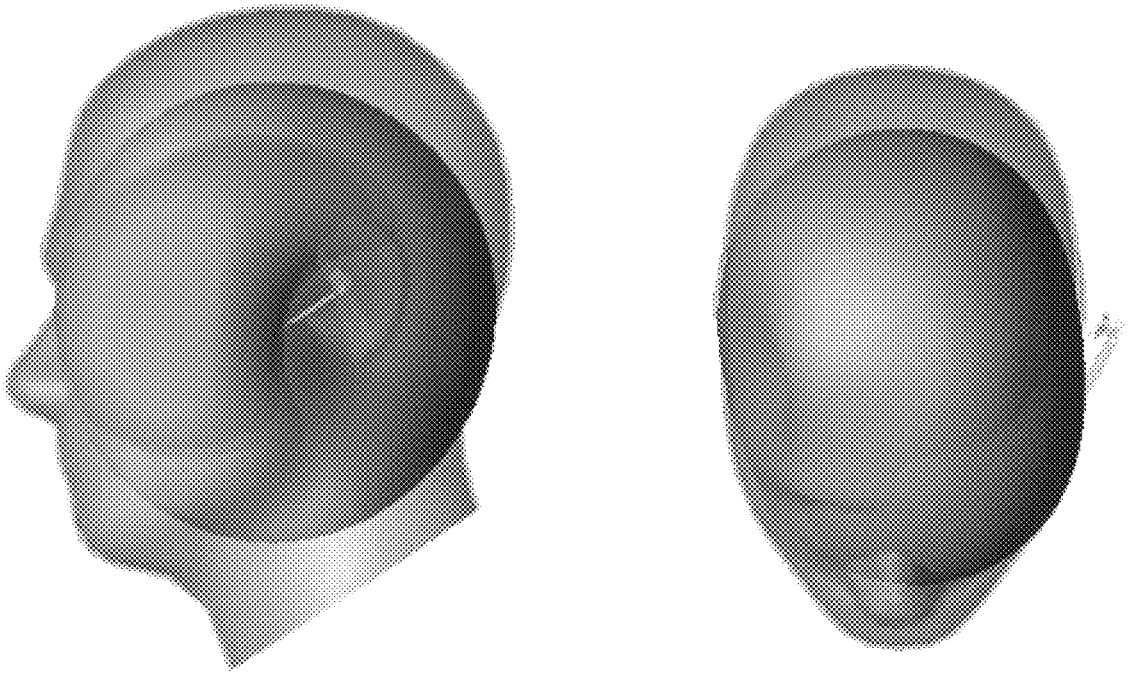
FIG. 13 is a schematic diagram in which a free space radiation field type of an antenna architecture of the Bluetooth earphone shown in FIG. 7 corresponds to a head phantom.
Figure 14:
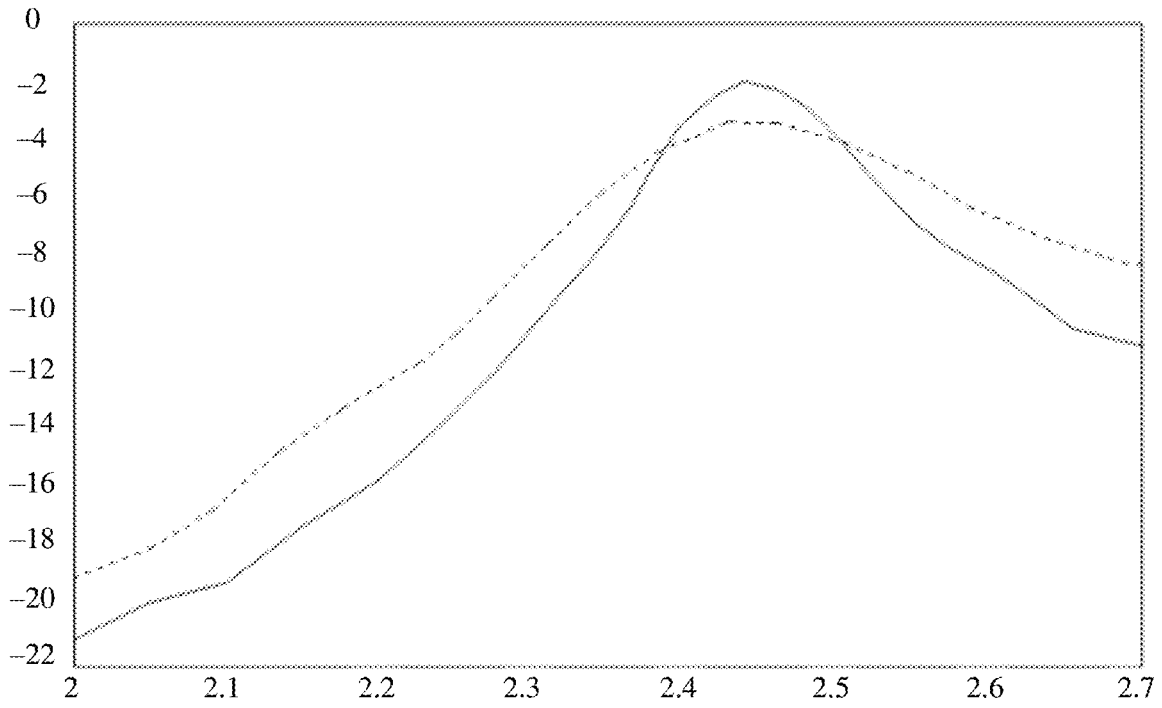
FIG. 14 is a comparison diagram of efficiency achieved when an antenna of the Bluetooth earphone shown in FIG. 7 is used in different environments.

Referring to both FIG. 13 and FIG. 14, FIG. 13 is a schematic diagram in which a free space radiation field type of the antenna architecture 3 of the Bluetooth earphone 100 shown in FIG. 7 corresponds to a head phantom, and FIG. 14 is a comparison diagram of efficiency achieved when the antenna 20 of the Bluetooth earphone 100 shown in FIG. 7 is used in different environments. A solid-line curve in FIG. 14 represents antenna efficiency achieved when the Bluetooth earphone 100 is not worn, namely, antenna efficiency achieved when the Bluetooth earphone 100 is in an initial state. A dashed-line curve in FIG. 14 represents antenna efficiency achieved when the Bluetooth earphone 100 is worn on the head of the user. In FIG. 14, a horizontal coordinate represents a frequency in a unit of gigahertz (GHz), and a vertical coordinate represents efficiency in a unit of decibel (dB).

It may be learned from FIG. 11 and FIG. 13 that when the user wears the Bluetooth earphone 100, the zero radiation point 3B of the radiation field type of the antenna architecture 3 of the Bluetooth earphone 100 faces the head of the user, the strong radiation point 3C is located in a direction substantially parallel to the head of the user, and the equivalent current 3*c* of the antenna architecture 3 of the Bluetooth earphone 100 is substantially parallel to the head of the user. It may be learned from FIG. 14 that when the zero radiation point 3B of the radiation field type of the antenna architecture 3 of the Bluetooth earphone 100 faces the head of the user, the antenna efficiency of the Bluetooth earphone 100 is slightly reduced but not greatly reduced when the user wears the earphone. In an example, the antenna efficiency can reach 80% or more of the antenna efficiency in the initial state. Therefore, the Bluetooth earphone 100 has relatively good antenna performance.

In conclusion, according to the Bluetooth earphone 100 shown in this embodiment of the present disclosure, the antenna 20 is arranged in the connecting section 21 and the top section 22 of the earphone handle portion 2, and a feed point of the antenna 20 is properly disposed in the connecting section 21 of the earphone handle portion 2, so that the electrical length of the equivalent current 3*c* obtained by combining the first current 3*a* formed on the antenna 20 and the second current 3*b* formed on the first extension part 402 of the flexible circuit board 40 meets a ½ wavelength resonant structure. In addition, after the Bluetooth earphone 100 is worn on the ear of the user, the zero radiation point 3B of the radiation field type generated by the equivalent current 3*c* faces the head of the user, to greatly reduce the adverse effect of the head of the user on the antenna 20, so that the antenna 20 has relatively good antenna performance.

Optionally, referring to FIG. 10A and FIG. 10B, a straight-line distance between the feeding end 301 and the tail end 302 is less than or equal to a straight-line distance between the feeding position 4011 and the first end portion 404. In this case, a length of the first equivalent current 3*a*' on the antenna 20 is less than or equal to a length of the second equivalent current 3*b*' on the first extension part 402. In this case, sizes of the antenna 30 and the flexible circuit board 40 are limited, to further limit the direction of the equivalent current 3*c*, so that the zero radiation point 3B of the radiation field type of the antenna architecture 3 can more accurately face the head of the user. In this way, the antenna 20 has better performance. In an example, a ratio of the straight-line distance between the feeding end 301 and the tail end 302 to the straight-line distance between the feeding position 4011 and the first end portion 404 may be greater than or equal to 1:2. That is, a ratio of the length of the first equivalent current 3*a*' to the length of the second equivalent current 3*b*' may be greater than or equal to 1:2.

In the embodiment of the present disclosure, the electrical length of the first current 3*a* of the Bluetooth earphone 100 may be implemented by adjusting a length of the antenna 20. For example, as shown in FIG. 10A, the antenna 20 is in a spiral shape, to overcome a problem that there is insufficient space in the top section 22 of the earphone handle portion 2 and to increase the length of the antenna 20, so that the electrical length of the first current 3*a* formed on the antenna 20 can meet a ¼ requirement. Further, the length of the antenna 20 may be changed by changing a quantity of winding turns, winding density, a winding shape, or the like of the antenna 20. In another embodiment, the antenna 20 may be disposed in a structure that includes a plurality of stacked antenna sections. A specific shape of the antenna 20 is not strictly limited in the present disclosure.

In the embodiment of the present disclosure, the electrical length of the second current 3*b* of the Bluetooth earphone 100 may be implemented by adjusting a length of the first extension part 402 of the flexible circuit board 40.

In an implementation, as shown in FIG. 9, the first end portion 404 may be extended in a direction far away from the feeding part 401, to increase the length of the first extension part 402. In this case, the first end portion 404 is disposed to increase the length of the first extension part 402, and may not be configured to be connected to another component of the Bluetooth earphone 100. For example, referring to FIG. 7 and FIG. 9, the chip 50 of the Bluetooth earphone 100 is fastened to the first extension part 402 of the flexible circuit board 40, and a fastening position is spaced from the first end portion 404. The fastening position is located between the first end portion 404 and the feeding part 401. The "fastening position" is a position, on the first extension part 402, used to fasten the chip 50. The receiver module 60 is electrically connected to the first extension part 402, and a connection position at which the first extension part 402 is connected to the receiver module 60 is spaced from the first end portion 404. The "connection position" is a position, in the first extension part 402, used to be electrically connected to the receiver module 60. In this embodiment, the connection position is located between the first end portion 404 and the feeding part 401. The first end portion 404 extends to a side that is of the receiver module 60 and that is far away from the earphone handle portion 2.

In another implementation, the length of the first extension part 402 may be adjusted by bending or straightening the first extension part 402. For example, as shown in FIG. 9, the first extension part 402 includes a plurality of regions (4021/4022) that are sequentially connected. The plurality of regions (4021/4022) include one or more flat regions 4021 and one or more curved regions 4022. For the first extension part 402, a straightened part is represented as the flat region 4021, and a bent part is represented as the curved region 4022. Areas and shapes of the flat regions 4021 in the plurality of regions (4021/4022) may be the same or different. The curved regions 4022 in the plurality of regions (4021/4022) may be the same or different. The length of the first extension part 402 may be effectively adjusted by bending or straightening the first extension part 402, that is, by increasing or decreasing a quantity or an area of flat regions 4021 and curved regions 4022, so that the electrical length of the second current 3*b* meets a requirement.

Optionally, the length of the first extension part 402 may be increased by bending the first extension part 402. For example, as shown in FIG. 9, the first extension part 402 includes a first flat region 4023, a first curved region 4024, and a second flat region 4025 that are sequentially connected. The first flat region 4023 and the second flat region 4025 are two flat regions 4021 of the first extension part 402. The first curved region 4024 is a curved region 4022 of the first extension part 402. The second flat region 4025 is bent with respect to the first flat region 4023, and there is an angle less than or equal to 90° between the second flat region 4025 and the first flat region 4023. In this case, the first extension part 402 forms a bent structure in the first flat region 4023, the first curved region 4024, and the second flat region 4025, and there is an angle less than or equal to 90° between the second flat region 4025 and the first flat region 4023. Therefore, the bent structure of the first extension part 402 is bent to a relatively large degree, and this helps to increase the length of the first extension part 402, so as to meet the electrical length requirement of the second current 3*b*.

In an example, as shown in FIG. 9, the first flat region 4023 is parallel to the second flat region 4025. In this case, the first flat region 4023 and the second flat region 4025 may approach each other, to avoid occupying excessive space while increasing the length of the first extension part 402. In another example, there is an acute angle less than 30° between the first flat region 4023 and the second flat region 4025. In this case, there is still a relatively short distance between the first flat region 4023 and the second flat region 4025. In still another example, there is an angle of 90° between the first flat region 4023 and the second flat region 4025. The first flat region 4023 and the second flat region 4025 are perpendicular to each other. In this case, the first flat region 4023 and the second flat region 4025 occupy relatively large space, and may be considered to be disposed at a position, in the Bluetooth earphone 100, at which there is relatively sufficient installation space.

Figure 15:
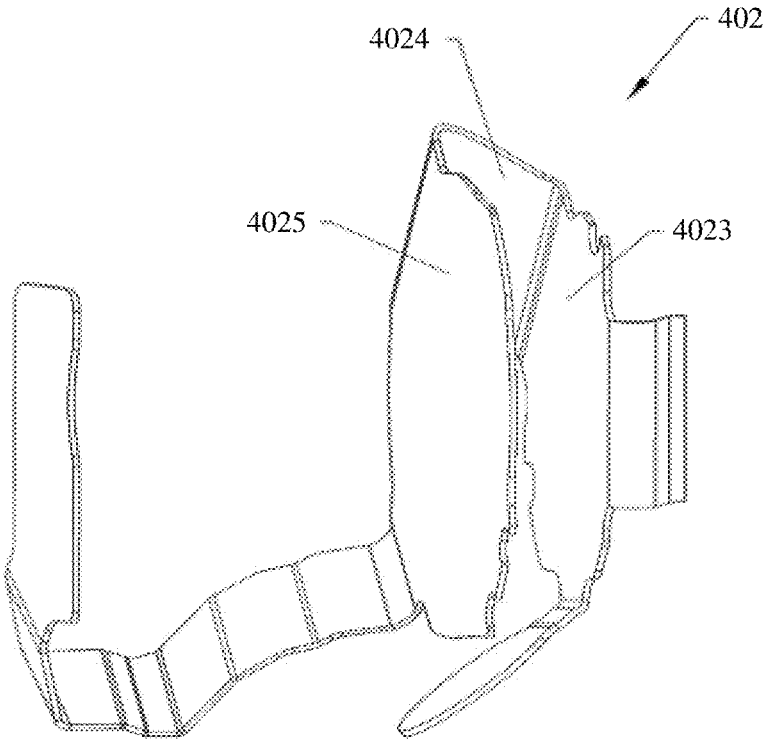
FIG. 15 is a schematic structural diagram, in another implementation, of a first extension part of the flexible circuit board shown in FIG. 9.

Optionally, the length of the first extension part 402 may be changed by changing a shape of the curved region 4022. In an example, as shown in FIG. 9, the first curved region 4024 is curved to a relatively large degree, and is relatively long in length, so that the first extension part 402 is relatively long in length. In another example, FIG. 15 is a schematic structural diagram, in another implementation, of the first extension part 402 of the flexible circuit board 40 shown in FIG. 9. The first curved region 4024 connected between the first flat region 4023 and the second flat region 4025 is curved to a relatively small degree, and is relatively short in length, so that the first extension part 402 is relatively short in length.

In another implementation, the Bluetooth earphone 100 may use a combination solution of the foregoing two implementations.

In the embodiment of the present disclosure, the second current 3*b* and the first current 3*a* are combined into the equivalent current 3*c* of a ½ wavelength, and the equivalent current 3*c* is in the resonant mode, and is an effective radiation current. The second extension part 403 of the flexible circuit board 40 is also connected to the feeding part 401, and therefore the second extension part 403 also forms a current. In the embodiment of the present disclosure, an electrical length of this part of current is further controlled, so that this part of current and the first current 3*a* cannot be combined into an equivalent current in the resonant mode to suppress radiation of this part of current, so as to ensure directivity and quality of the effective radiation current. In this way, relatively good antenna performance is achieved.

Specifically, as shown in FIG. 10A and FIG. 10B, the flexible circuit board 40 is further configured to form a third current 3*d* that extends from the feeding position 4011 to the second end portion 405. The third current 3*d* is a ground current. An electrical length of the third current 3*d* is not equal to the electrical length of the second current 3*b*. As shown in FIG. 10A, a flow direction of the third current 3*d* varies with a shape of a part, of the flexible circuit board 40, from the feeding position 4011 to the second end portion 405. For ease of description, the third current 3*d* is equivalent to a longitudinal third equivalent current 3*d*' in FIG. 10B.

In this embodiment, the electrical length of the second current 3*b* is a ¼ wavelength, and the electrical length of the third current 3*d* is not equal to the electrical length of the second current 3*b*, and therefore the electrical length of the third current 3*d* is not equal to a ¼. An electrical length of an equivalent current (not shown in the figure) obtained by combining the third current 3*d* and the first current 3*a* is not equal to a ½ wavelength, and the equivalent current is not in the resonant mode. Therefore, the third current 3*d* does not radiate, and the Bluetooth earphone 100 can effectively suppress radiation of the third current 3*d*.

In the embodiment of the present disclosure, the electrical length of the third current 3*d* of the Bluetooth earphone 100 may be implemented by adjusting a length of the second extension part 403 of the flexible circuit board 40.

In an implementation, the length of the second extension part 403 may be adjusted by bending or straightening the second extension part 403. For example, as shown in FIG. 9, the second extension part 403 includes a plurality of regions (4031/4032) that are sequentially connected. The plurality of regions (4031/4032) include one or more flat regions 4031 and one or more curved regions 4032. For the second extension part 403, a straightened part is represented as the flat region 4031, and a bent part is represented as the curved region 4032. Areas and shapes of the flat regions 4031 in the plurality of regions (4031/4032) may be the same or different. The curved regions 4032 in the plurality of regions (4031/4032) may be the same or different. The length of the second extension part 403 may be effectively adjusted by bending or straightening the second extension part 403, that is, by increasing or decreasing a quantity or an area of flat regions 4031 and curved regions 4032, so that the third current 3*d* meets an electrical length requirement.

Optionally, the length of the second extension part 403 may be increased by bending the second extension part 403. For example, as shown in FIG. 9, the second extension part 403 includes a third flat region 4033, a second curved region 4034, and a fourth flat region 4035 that are sequentially connected. The third flat region 4033 and the fourth flat region 4035 are two flat regions 4031 of the second extension part 403. The second curved region 4034 is a curved region 4032 of the second extension part 403. The third flat region 4033 is bent with respect to the fourth flat region 4035, and there is an angle less than or equal to 90° between the third flat region 4033 and the fourth flat region 4035. In this case, the second extension part 403 forms a bent structure in the third flat region 4033, the second curved region 4034, and the fourth flat region 4035, and there is an angle less than or equal to 90° between the third flat region 4033 and the fourth flat region 4035. Therefore, the bent structure of the second extension part 403 is bent to a relatively large degree, and this helps to increase the length of the second extension part 403, so as to meet the electrical length requirement of the third current 3*d*.

In an example, there is an angle of 90° between the third flat region 4033 and the fourth flat region 4035. The third flat region 4033 and the fourth flat region 4035 are perpendicular to each other. As shown in FIG. 9, the third flat region 4033 and the fourth flat region 4035 may be located on a side that is of the second extension part 403 and that is close to the feeding part 401. There is relatively three-dimensional space in the connecting section 21 of the earphone handle portion 2, and therefore the third flat region 4033 and the fourth flat region 4035 can be smoothly accommodated. In another example, the third flat region 4033 and the fourth flat region 4035 are parallel to each other. In this case, the third flat region 4033 and the fourth flat region 4035 may approach each other, to avoid occupying excessive space while increasing the length of the second extension part 403. As shown in FIG. 9, the third flat region 4033 and the fourth flat region 4035 may be located in the second end portion 405, and the third flat region 4033 and the fourth flat region 4035 are stacked. In still another example, there may be an acute angle less than 30° between the third flat region 4033 and the fourth flat region 4035. In this case, there is still a relatively short distance between the third flat region 4033 and the fourth flat region 4035.

Figure 16:
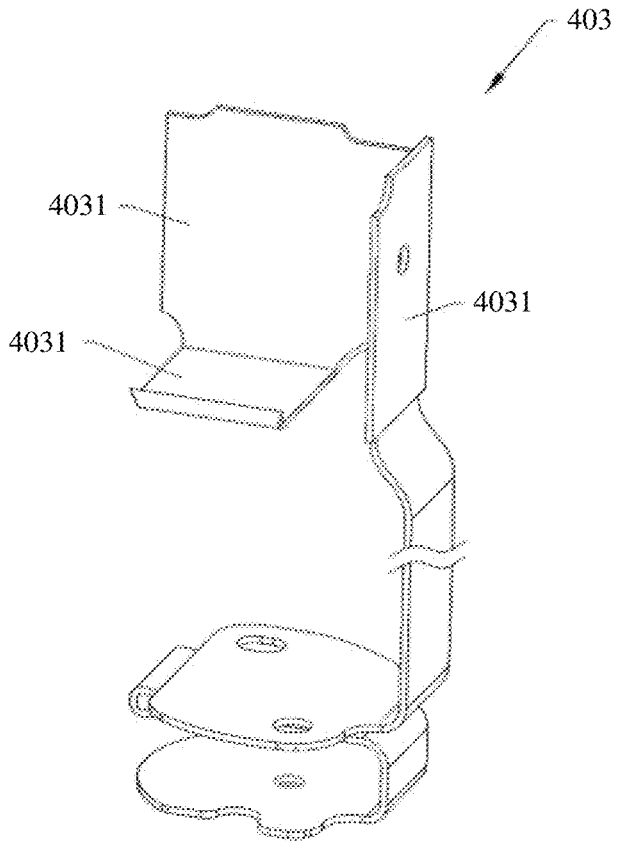
FIG. 16 is a schematic structural diagram, in another implementation, of a second extension part of the flexible circuit board shown in FIG. 9.

Optionally, the length of the second extension part 403 may be decreased by straightening the second extension part 403. Referring to both FIG. 9 and FIG. 16, FIG. 16 is a schematic structural diagram, in another implementation, of the second extension part 403 of the flexible circuit board 40 shown in FIG. 9. In the implementation shown in FIG. 9, three bent structures are disposed at an end at which the second extension part 403 is connected to the feeding part 401, and four flat regions 4031 are formed. In the implementation shown in FIG. 16, two bent structures are disposed at the end at which the second extension part 403 is connected to the feeding part 401, and three flat regions 4031 are formed. In comparison with the implementation shown in FIG. 9, in the implementation shown in FIG. 16, one bent structure is omitted at the end at which the second extension part 403 is connected to the feeding part 401, a part of the second extension part 403 is straightened, one flat region 4031 is omitted, and the length of the second extension part 403 is shortened, and therefore the electrical length of the third current 3*d* is shortened.

Figure 17:
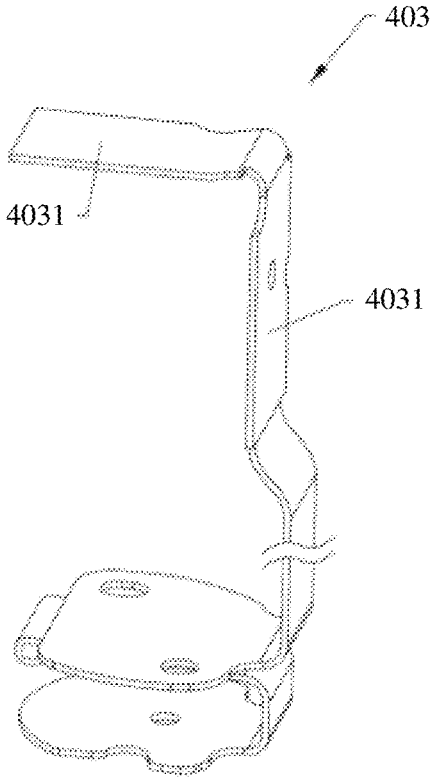
FIG. 17 is a schematic structural diagram, in still another implementation, of a second extension part of the flexible circuit board shown in FIG. 9.
Figure 18:
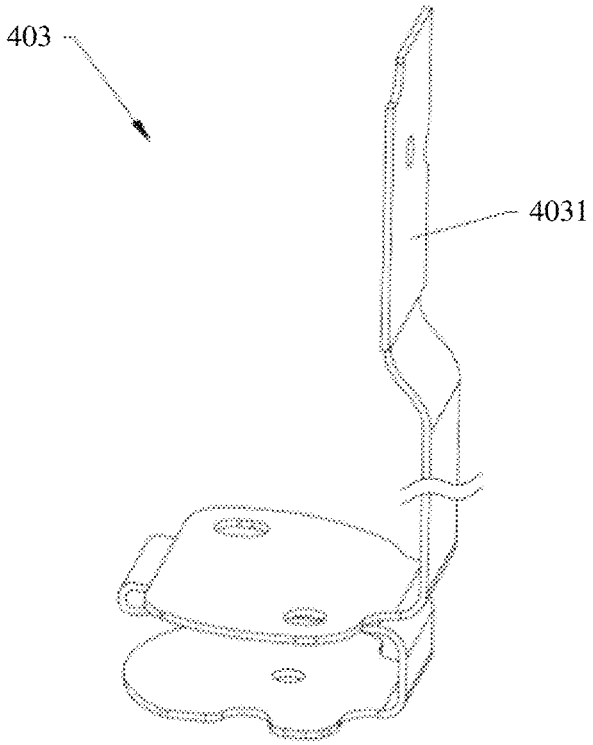
FIG. 18 is a schematic structural diagram, in still another implementation, of a second extension part of the flexible circuit board shown in FIG. 9.

Further, referring to both FIG. 17 and FIG. 18, FIG. 17 is a schematic structural diagram, in still another implementation, of the second extension part 403 of the flexible circuit board 40 shown in FIG. 9, and FIG. 18 is a schematic structural diagram, in still another implementation, of the second extension part 403 of the flexible circuit board 40 shown in FIG. 9. In the implementation shown in FIG. 17, one bent structure is disposed at the end at which the second extension part 403 is connected to the feeding part 401, and two flat regions 4031 are formed. In the implementation shown in FIG. 18, no bent structure is disposed at the end at which the second extension part 403 is connected to the feeding part 401, and one flat region 4031 is formed. In comparison with the implementation shown in FIG. 16, in the implementations shown in FIG. 17 and FIG. 18, a quantity of bent structures is further reduced, a part of the second extension part 403 is further straightened, a quantity of flat regions 4031 is reduced, and the length of the second extension part 403 is shortened, and therefore the electrical length of the third current 3*d* is shortened.

In the foregoing implementations, the second extension part 403 is designed to be bent or straightened at the end close to the feeding part 401, so that the length of the second extension part 403 meets a requirement, and the electrical length of the third current 3*d* can be not equal to the ¼. In this case, the second end portion 405 of the second extension part 403 may be located at an end that is of the bottom section 23 of the earphone handle portion 2 and that is far away from the connecting section 21 of the earphone handle portion 2, that is, located at a bottom end of the entire earphone handle portion 2, so that some components of the Bluetooth earphone 100 are more flexibly arranged.

Details are as follows:

Optionally, referring to FIG. 7, a connection terminal 701 of the battery 70 is disposed opposite to the connecting section 21 of the earphone handle portion 2, and is connected to the second end portion 405. In this case, the connection terminal 701 of the battery 70 is disposed towards the bottom end of the earphone handle portion 2, and a connection structure between the connection terminal 701 of the battery 70 and the flexible circuit board 40 is located near the bottom end of the earphone handle portion 2. Therefore, this is conducive to a subsequent repair operation on the battery 70. In another embodiment, the connection terminal 701 of the battery 70 may be disposed towards the connecting section 21 of the earphone handle portion 2. In this case, the connection terminal 701 of the battery 70 is connected to an end that is of the second extension part 403 and that is close to the feeding part 401.

Optionally, referring to FIG. 7, the microphone module 90 is located in the bottom section 23 of the earphone handle portion 2, and is located on a side that is of the battery 70 and that is far away from the connecting section 21 of the earphone handle portion 2. The microphone module 90 is connected to the second end portion 405. The microphone module 90 is closer to the bottom end of the earphone handle portion 2 than the battery 70. In this case, when the user wears the Bluetooth earphone 100, a sound signal sent by the user can be received by the microphone module 90 with better quality and at a faster speed, to ensure sound reception quality and efficiency of the Bluetooth earphone 100. Similarly, this is more conducive to a subsequent repair operation on the microphone module 90.

Figure 19:
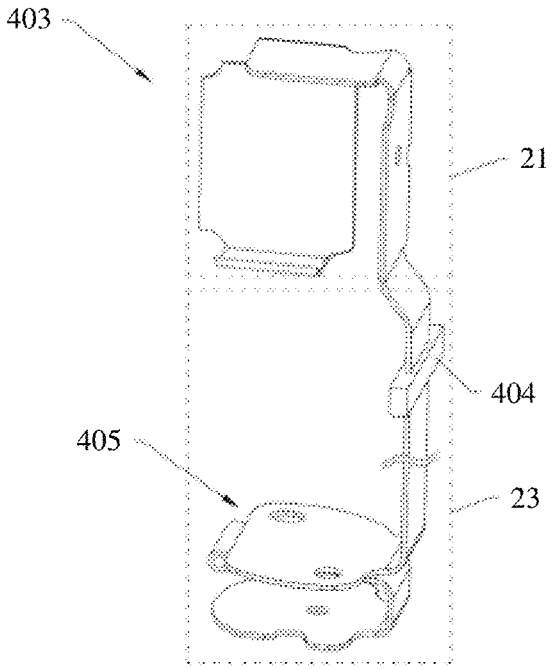
FIG. 19 is a schematic structural diagram, in still another implementation, of a second extension part of the flexible circuit board shown in FIG. 9.

In another implementation, an element may be connected in series to the second extension part 403, to cut off the third current 3*d*, so that the third current 3*d* meets the electrical length requirement. For example, FIG. 19 is a schematic structural diagram, in still another implementation, of the second extension part 403 of the flexible circuit board 40 shown in FIG. 9. The flexible circuit board 40 further includes a low-pass high-resistance element 404, and the low-pass high-resistance element 404 is connected in series between the feeding part 401 (referring to FIG. 9) and the second end portion 405. That is, the low-pass high-resistance element 404 is connected in series to the second extension part 403, and is located between the feeding part 401 and the second end portion 405. The low-pass high-resistance element 404 is configured to: allow a current at a frequency band lower than a Bluetooth signal frequency band to pass through, and prevent a current at a frequency band close to the Bluetooth signal frequency band from passing through.

In this implementation, a Bluetooth signal works near 2.4 gigahertz (GHz), and a parameter of the low-pass high-resistance element 404 is designed, to allow the current at the frequency band lower than the Bluetooth signal frequency band to pass through and intercept the current at the frequency band close to the Bluetooth signal frequency band, so as to change the electrical length of the third current 3*d*.

In this case, the second end portion 405 may still extend to an end that is of the bottom section 23 of the earphone handle portion 2 and that is far away from the connecting section 21 of the earphone handle portion 2, so as to be located at the bottom end of the earphone handle portion 2. The connection terminal 701 of the battery 70 may be still disposed opposite to the connecting section 21 of the earphone handle portion 2, and is connected to the second end portion 405. The microphone module 90 may be still located in the bottom section 23 of the earphone handle portion 2, and is located on a side that is of the battery 70 and that is far away from the connecting section 21 of the earphone handle portion 2. The microphone module 90 is connected to the second end portion 405. A frequency band of each of a current of the battery 70 and a current of the microphone module 90 is far lower than the Bluetooth signal frequency band, and therefore the current of the battery 70 and the current of the microphone module 90 may be transmitted between the second end portion 405 and the chip 50 through the low-pass high-resistance element 404.

Optionally, the low-pass high-resistance element 404 may be an inductor or a ferrite bead. For example, when the low-pass high-resistance element 404 is an inductor, impedance of the inductor may be greater than 1 nanohenry (nH), for example, may range from 20 nanohenries to 70 nanohenries.

In another implementation, the Bluetooth earphone 100 may use a combination solution of the foregoing two implementations.

It may be understood that in another embodiment, for the Bluetooth earphone 100, the electrical length of the third current 3*d* may be controlled by adjusting the length of the second extension part 403, so that the electrical length of the third current 3*d* is not equal to the ¼, but is close to the ¼. In this case, a small part of the equivalent current obtained by combining the third current 3*d* and the first current 3*a* is involved in radiation, and a proportion of a part involved in radiation to the third current 3*d* is significantly less than a proportion of a part involved in radiation to the second current 3*b*, so that the direction of the effective radiation current of the antenna 20 is slightly rotated clockwise or counterclockwise, and an orientation of the radiation field type of the antenna 20 is adaptively changed. In other words, in the embodiments of the present disclosure, the third current 3*d* may be set for angles at which the Bluetooth earphone 100 of different models is worn, so that a small part of the third current 3*d* can be involved in radiation, to adjust the direction of the effective radiation current of the antenna 20 to a proper orientation. In this way, the zero radiation point 3B of the radiation field type of the antenna 20 more accurately faces the head of the user, to achieve relatively good antenna performance.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. If there is no conflict, the embodiments of the present disclosure and the features in the embodiments may be combined with each other. Therefore, the protection scope of the present disclosure shall be subject to the protection scope of the claims.

What is claimed is:

1. A Bluetooth earphone, comprising:

an earbud portion, wherein a receiver is disposed in the earbud portion;

an earphone handle portion, comprising:

a connecting section connected to the earbud portion; and a top section and a bottom section located on opposite sides of the connecting section, and wherein a battery is disposed in the bottom section of the earphone handle portion; and an antenna architecture, comprising:

an antenna extending from the connecting section of the earphone handle portion to the top section of the earphone handle portion; and a flexible circuit board, comprising a feeding part and a first extension part connected to the feeding part, wherein the feeding part is located in the connecting section of the earphone handle portion and is coupled to the antenna, and the first extension part extends to the earbud portion.

2. The Bluetooth earphone according to claim 1, wherein:

the antenna comprises a feeding end and a tail end that is separate from the feeding end, the feeding end is coupled to the feeding part, and the antenna is configured to form a first current that extends from the feeding end to the tail end; and the feeding part comprises a feeding position coupled to the antenna, the first extension part comprises a first end portion that is separate from the feeding part, and the flexible circuit board is configured to form a second current that extends from the first end portion to the feeding position.

3. The Bluetooth earphone according to claim 2, wherein a straight-line distance between the feeding end and the tail end is less than or equal to a straight-line distance between the feeding position and the first end portion.

4. The Bluetooth earphone according to claim 2, wherein the receiver is electrically connected to the first extension part, and a connection position at which the first extension part is connected to the receiver is separate from the first end portion.

5. The Bluetooth earphone according to claim 2, wherein the first extension part comprises a plurality of regions that are sequentially connected, and the plurality of regions comprise one or more flat regions and one or more curved regions.

6. The Bluetooth earphone according to claim 5, wherein the first extension part comprises a first flat region, a first curved region, and a second flat region that are sequentially connected, the second flat region is bent with respect to the first flat region, and an angle between the second flat region and the first flat region is less than or equal to 90°.

7. The Bluetooth earphone according to claim 2, wherein:

the flexible circuit board further comprises a second extension part connected to the feeding part, the second extension part extends from the connecting section of the earphone handle portion to the bottom section of the earphone handle portion, and the second extension part comprises a second end portion that is separate from the feeding part; and the flexible circuit board is further configured to form a third current that extends from the feeding position to the second end portion, and an electrical length of the third current is different than an electrical length of the second current.

8. The Bluetooth earphone according to claim 7, wherein a connection terminal of the battery is disposed opposite to the connecting section of the earphone handle portion, and is connected to the second end portion.

9. The Bluetooth earphone according to claim 8, further comprising:

a microphone, located in the bottom section of the earphone handle portion, and located on a side of the battery that faces away from the connecting section of the earphone handle portion, and wherein the microphone is connected to the second end portion.

10. The Bluetooth earphone according to claim 7, wherein the flexible circuit board further comprises a low-pass high-resistance element, and the low-pass high-resistance element is connected in series between the feeding part and the second end portion.

11. The Bluetooth earphone according to claim 7, wherein the second extension part comprises a plurality of regions that are sequentially connected, and the plurality of regions comprise one or more flat regions and one or more curved regions.

12. The Bluetooth earphone according to claim 11, wherein the second extension part comprises a third flat region, a second curved region, and a fourth flat region that are sequentially connected, the third flat region is bent with respect to the fourth flat region, and an angle between the third flat region and the fourth flat region is less than or equal to 90°.

13. The Bluetooth earphone according to claim 1, wherein the antenna is a monopole antenna.

14. The Bluetooth earphone according to claim 1, wherein the antenna is a ceramic antenna.

15. The Bluetooth earphone according to claim 1, wherein the antenna is an inverted-F antenna.

16. The Bluetooth earphone according to claim 15, wherein the antenna is a circuit board antenna.

17. The Bluetooth earphone according to claim 1, wherein the antenna is a stamping antenna.

18. The Bluetooth earphone according to claim 1, wherein the antenna is a laser direct structuring antenna.

19. The Bluetooth earphone according to claim 1, wherein the antenna is an insert molding antenna.

* * * * *